US009464801B2

(12) United States Patent
Van De Ven et al.

(10) Patent No.: US 9,464,801 B2
(45) Date of Patent: Oct. 11, 2016

(54) LIGHTING DEVICE WITH ONE OR MORE REMOVABLE HEAT SINK ELEMENTS

(75) Inventors: Antony Paul Van De Ven, Hong Kong (CN); Paul Kenneth Pickard, Morrisville, NC (US); James Michael Lay, Cary, NC (US); Wai Kwan Chan, Hong Kong (CN)

(73) Assignee: Cree, Inc., Durham, NC (US)

( * ) Notice: Subject to any disclaimer, the term of this patent is extended or adjusted under 35 U.S.C. 154(b) by 927 days.

(21) Appl. No.: 12/566,850

(22) Filed: Sep. 25, 2009

(65) Prior Publication Data

US 2011/0074265 A1 Mar. 31, 2011

(51) Int. Cl.

| | |
|---|---|
| ***H01J 61/52*** | (2006.01) |
| ***F21V 29/74*** | (2015.01) |
| ***F21S 8/02*** | (2006.01) |
| ***F21V 29/00*** | (2015.01) |
| ***F21K 99/00*** | (2016.01) |
| ***F21V 29/77*** | (2015.01) |
| *F21Y 101/02* | (2006.01) |

(52) U.S. Cl.

CPC ..... *F21V 29/74* (2015.01); *F21K 9/137* (2013.01); *F21K 9/54* (2013.01); *F21S 8/02* (2013.01); *F21S 8/026* (2013.01); *F21V 29/004* (2013.01); *F21V 29/745* (2015.01); *F21V 29/77* (2015.01); *F21Y 2101/02* (2013.01)

(58) Field of Classification Search

CPC ..... F21S 8/02; F21V 29/004; F21V 29/745
USPC ..... 313/46; 362/373, 230, 365, 234
See application file for complete search history.

(56) References Cited

U.S. PATENT DOCUMENTS

| | | | | |
|---|---|---|---|---|
| 3,755,697 | A | 8/1973 | Miller | |
| 3,787,752 | A | 1/1974 | Delay | |
| 4,090,189 | A | 5/1978 | Fisler | |
| 4,459,648 | A * | 7/1984 | Ullman | 362/307 |
| 4,717,868 | A | 1/1988 | Peterson | |
| 4,841,422 | A * | 6/1989 | Groh | 362/294 |
| 4,918,487 | A | 4/1990 | Coulter, Jr. | |
| 5,151,679 | A | 9/1992 | Dimmick | |
| 5,175,528 | A | 12/1992 | Choi et al. | |

(Continued)

FOREIGN PATENT DOCUMENTS

WO 2008/123670 10/2008

OTHER PUBLICATIONS

U.S. Appl. No. 12/566,857, filed Sep. 25, 2009, Van de Ven.

(Continued)

*Primary Examiner* — Elmito Breval
(74) *Attorney, Agent, or Firm* — Burr & Brown, PLLC

(57) ABSTRACT

A lighting device comprising at least a first light source and at least one heat sink element that is removable, that comprises an first inner region and an first outer region, that is identical in shape to another heat sink element, that is in thermal contact with a trim element, that is stacked, that is in thermal contact with at least a first portion of a first surface of the trim element, that has a cross-sectional area at a first distance from an axis of a trim element that is larger than at a shorter distance, and/or that maintains a junction temperature of a lighting device at or below a recommended junction temperature. Also, a lighting device comprising at least a first light source, a trim element, a driver sub-assembly and a spacer element positioned between the trim element and the driver sub-assembly. Also, methods of dissipating heat.

61 Claims, 10 Drawing Sheets

(56) References Cited

U.S. PATENT DOCUMENTS 5,345,167 A 9/1994 Hasegawa et al.
5,631,190 A 5/1997 Negley
5,661,645 A 8/1997 Hochstein
5,736,881 A 4/1998 Ortiz
5,844,377 A 12/1998 Anderson et al.
5,912,477 A 6/1999 Negley
5,912,568 A 6/1999 Kiley
6,095,671 A * 8/2000 Hutain ..... 362/373
6,150,771 A 11/2000 Perry
6,161,910 A 12/2000 Reisenauer et al.
6,222,172 B1 4/2001 Fossum et al.
6,285,139 B1 9/2001 Ghanem
6,329,760 B1 12/2001 Bebenroth
6,340,868 B1 1/2002 Lys et al.
6,362,578 B1 3/2002 Swanson et al.
6,388,393 B1 5/2002 Illingworth
6,400,101 B1 6/2002 Biebl et al.
6,528,954 B1 3/2003 Lys et al.
6,577,072 B2 6/2003 Saito et al.
6,586,890 B2 7/2003 Min et al.
6,614,358 B1 9/2003 Hutchison et al.
6,636,003 B2 10/2003 Rahm et al.
6,724,376 B2 4/2004 Sakura et al.
6,747,420 B2 6/2004 Barth et al.
6,808,287 B2 10/2004 Lebens et al.
6,836,081 B2 12/2004 Swanson et al.
6,841,947 B2 1/2005 Berg-Johansen
6,873,203 B1 3/2005 Latham, II et al.
6,987,787 B1 1/2006 Mick
6,995,518 B2 2/2006 Havlik et al.
7,038,399 B2 5/2006 Lys et al.
7,071,762 B2 7/2006 Xu et al.
7,119,498 B2 10/2006 Baldwin et al.
7,180,487 B2 2/2007 Kamikawa et al.
7,202,608 B2 4/2007 Robinson et al.
7,213,940 B1 5/2007 Van De Ven et al.
7,794,114 B2 * 9/2010 Medendorp, Jr. ..... 362/294
8,070,328 B1 * 12/2011 Knoble ..... F21V 3/00 362/245
2007/0139923 A1 6/2007 Negley
2007/0170447 A1 7/2007 Negley
2007/0171145 A1 7/2007 Coleman
2007/0236911 A1 10/2007 Negley
2007/0263393 A1 11/2007 Van de Ven
2007/0274063 A1 11/2007 Negley
2007/0274080 A1 11/2007 Negley
2007/0278934 A1 12/2007 Van de Ven
2007/0278974 A1 12/2007 Van de Ven
2007/0279440 A1 12/2007 Negley
2007/0279903 A1 12/2007 Negley
2007/0280624 A1 12/2007 Negley
2008/0084685 A1 4/2008 Van de Ven
2008/0084700 A1 4/2008 Van de Ven
2008/0084701 A1 4/2008 Van de Ven
2008/0088248 A1 4/2008 Myers
2008/0089053 A1 4/2008 Negley
2008/0106895 A1 5/2008 Van de Ven
2008/0106907 A1 * 5/2008 Trott et al. ..... 362/368
2008/0112168 A1 * 5/2008 Pickard et al. ..... 362/247
2008/0112170 A1 * 5/2008 Trott et al. ..... 362/311
2008/0112183 A1 5/2008 Negley
2008/0130285 A1 6/2008 Negley
2008/0137347 A1 6/2008 Trott
2008/0186704 A1 * 8/2008 Chou et al. ..... 362/249
2008/0278950 A1 11/2008 Pickard
2008/0278952 A1 11/2008 Trott
2008/0278957 A1 11/2008 Pickard
2008/0304261 A1 12/2008 Van de Ven
2008/0304269 A1 12/2008 Pickard
2008/0309255 A1 12/2008 Myers
2009/0086474 A1 4/2009 Chou
2009/0108269 A1 4/2009 Negley
2009/0160363 A1 6/2009 Negley
2009/0161356 A1 6/2009 Negley
2009/0184662 A1 7/2009 Given
2009/0184666 A1 7/2009 Myers
2009/0296384 A1 12/2009 Van de Ven
2010/0027258 A1 2/2010 Maxik et al.
2010/0039829 A1 * 2/2010 Tsai ..... 362/373
2010/0102199 A1 4/2010 Negley
2010/0102697 A1 4/2010 Van de Ven
2010/0103678 A1 4/2010 Van de Ven
2010/0220487 A1 * 9/2010 Ming et al. ..... 362/373
2010/0225220 A1 9/2010 Tanaka et al.
2010/0246178 A1 * 9/2010 Giardina et al. ..... 362/249.02
2010/0259919 A1 * 10/2010 Khazi ..... F21S 8/026 362/84

OTHER PUBLICATIONS

U.S. Appl. No. 12/621,970, filed Nov. 19, 2009, Van de Ven.
U.S. Appl. No. 12/566,142, filed Sep. 24, 2009.
U.S. Appl. No. 12/566,195, filed Sep. 24, 2009.
U.S. Appl. No. 13/026,495, filed Feb. 14, 2011, Pickard et al.

* cited by examiner

FIG.20
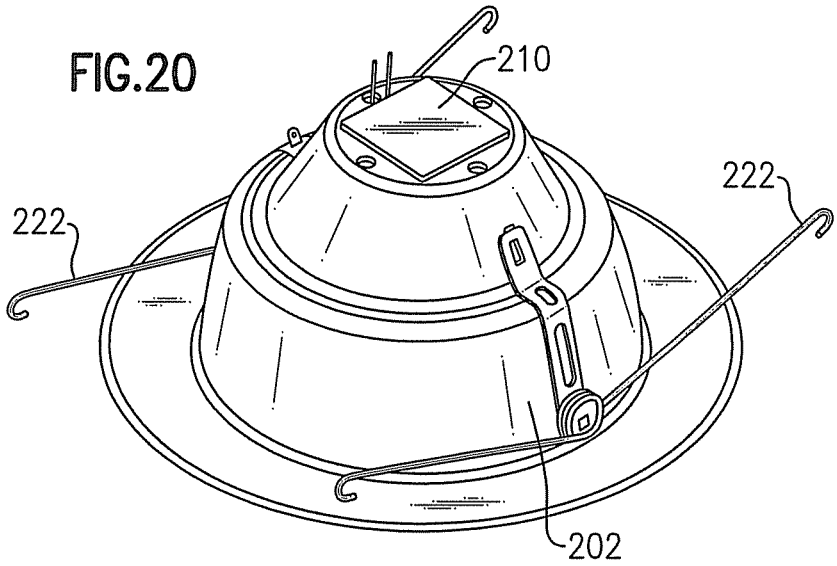
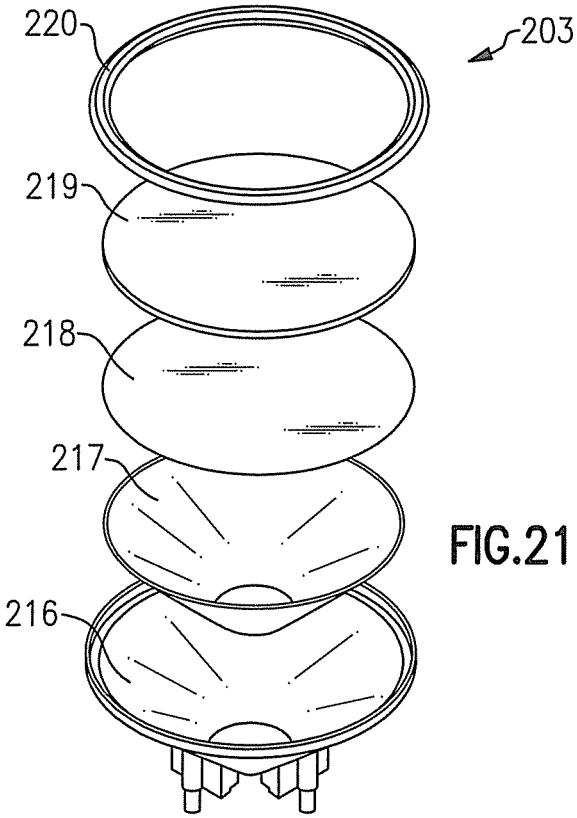
FIG.21
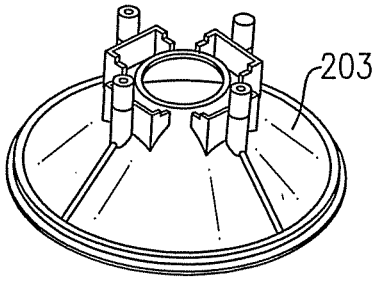
FIG.22

LIGHTING DEVICE WITH ONE OR MORE REMOVABLE HEAT SINK ELEMENTS

FIELD OF THE INVENTIVE SUBJECT MATTER

The present inventive subject matter is directed to a lighting device that includes one or more heat sink elements. In some aspects, the present inventive subject matter is directed to a lighting device that comprises one or more solid state light emitters (e.g., one or more light emitting diodes) and one or more heat sink elements. In some aspects, the present inventive subject matter is directed to such light devices which comprise one or more removable heat sink elements.

BACKGROUND

There are a wide variety of light sources in existence, e.g., incandescent lights, fluorescent lamps, solid state light emitters, laser diodes, thin film electroluminescent devices, light emitting polymers (LEPs), halogen lamps, high intensity discharge lamps, electron-stimulated luminescence lamps, etc. The various types of light sources have been provided in a variety of shapes, sizes and arrangements, e.g., A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc. The various types of light sources have been supplied with energy with an Edison connector, a battery connection, a GU24 connector, direct wiring to a branch circuit, etc. The various types of light sources have been designed so as to serve any of a variety of functions (e.g., as a flood light, as a spotlight, as a downlight, etc.), and have been used in residential, commercial or other applications.

With many light sources, there is a desire to effectively dissipate heat generated in generating light.

For example, with many incandescent light sources, about ninety percent of the electricity consumed is released as heat rather than light. There are many situations where effective heat dissipation is needed or desired for such incandescent light sources.

Solid state light emitters (e.g., light emitting diodes) are receiving much attention due to their energy efficiency. A challenge with solid state light emitters is that the performance of many solid state light emitters may be reduced when they are subjected to elevated temperatures. For example, many light emitting diode light sources have average operating lifetimes of decades (as opposed to just months or 1-2 years for many incandescent bulbs), but some light emitting diodes' lifetimes can be significantly shortened if they are operated at elevated temperatures. A common manufacturer recommendation is that the junction temperature of a light emitting diode should not exceed 85 degrees C. if a long lifetime is desired.

In addition, the intensity of light emitted from some solid state light emitters varies based on ambient temperature. For example, light emitting diodes that emit red light often have a very strong temperature dependence (e.g., AlInGaP light emitting diodes can reduce in optical output by ~20% when heated up by ~40 degrees C., that is, approximately −0.5% per degree C.; and blue InGaN+YAG:Ce light emitting diodes can reduce by about −0.15%/degree C.). In many lighting devices that include solid state light emitters as light sources (e.g., general illumination devices that emit white light in which the light sources consist of light emitting diodes), a plurality of solid state light emitters are provided that emit light of different colors which, when mixed, are perceived as the desired color for the output light (e.g., white or near-white). The desire to maintain a relatively stable color of light output is therefore an important reason to try to reduce temperature variation of solid state light emitters.

There are a variety of lighting devices that generate heat at a wide variety of different rates. It would be desirable to provide lighting devices in which the amount of heat that can be dissipated can be selected to match the rate of heat generation by each individual lighting device. For example, it would be advantageous to be able to provide a series of lighting devices (or any of the members of such a series) in which each member of the series has a different number of light emitting diodes, resulting in respective different rates of heat generation, and to be able to easily provide the respective lighting devices with correspondingly different rates of heat dissipation sufficient for dissipating the respective different rates of heat generation. It would be desirable to be able to provide incrementally different rates of heat dissipation in such devices.

BRIEF SUMMARY OF THE INVENTIVE SUBJECT MATTER

In some aspects, the present inventive subject matter provides lighting devices that can provide such features.

In some embodiments according to the present inventive subject matter, there is provided a lighting device that has at least one heat sink element that can readily be removed and/or replaced, e.g., if testing reveals that slightly more heat dissipation is needed or slightly less heat dissipation is needed.

In some embodiments, there is provided heat sink elements that can readily be removed from a lighting device and/or attached to a lighting device.

In some embodiments according to the present inventive subject matter, a heat sink element can be selected (or a group of heat sink elements can be selected) so as to provide a desired rate of heat dissipation under specific circumstances (e.g., when all of the light sources in the lighting device being fully illuminated and after thermal equilibrium has been reached, and under typical air flow conditions).

In some embodiments according to the present inventive subject matter, a plurality of heat sink elements can be provided so that a desired heat sink element or combination of heat sink elements can be selected and attached to the lighting device in order to provide a desired amount of heat dissipation capability based on the heat generation characteristics of the one or more light sources in the lighting device.

In some aspects of the present inventive subject matter, there is provided a lighting device that comprises at least a first removable heat sink element.

In some aspects of the present inventive subject matter, there is provided a lighting device that comprises at least a first light source and at least a first removable heat sink element.

In some aspects of the present inventive subject matter, there is provided a lighting device that comprises a trim element and at least a first removable heat sink element.

In some aspects of the present inventive subject matter, there is provided a lighting device that comprises a trim element, at least a first light source, and at least a first removable heat sink element.

A variety of representative embodiments of removable heat sink elements are described below.

The inventive subject matter may be more fully understood with reference to the accompanying drawings and the following detailed description of the inventive subject matter.

BRIEF DESCRIPTION OF THE DRAWING FIGURES

Figure 1:
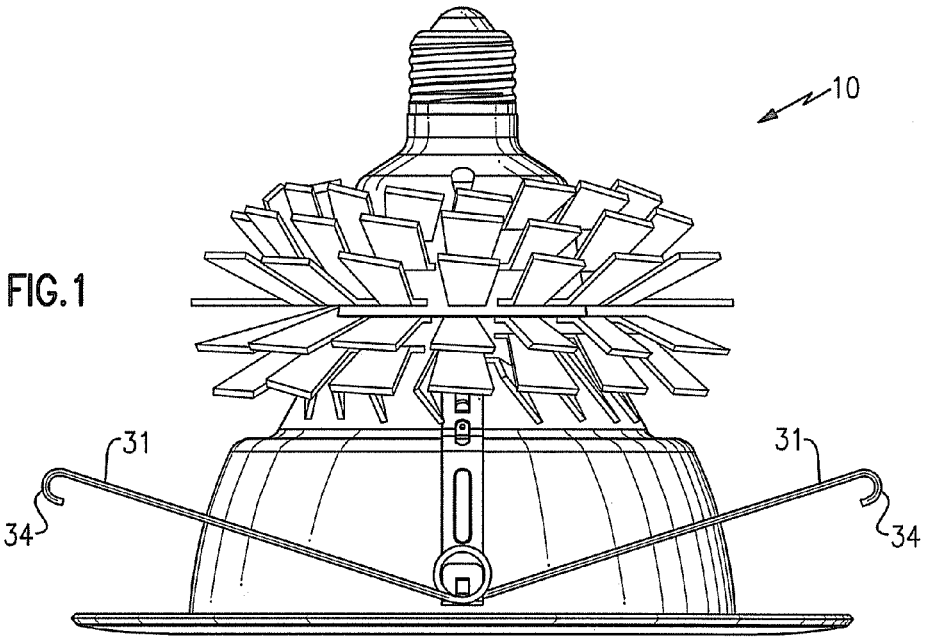
FIG. 1 is a schematic front elevation view of a lighting device 10.

FIGS. 15-22 schematically depict a lighting device 200 in accordance with the present inventive subject matter.

DETAILED DESCRIPTION OF THE INVENTIVE SUBJECT MATTER

The present inventive subject matter now will be described more fully hereinafter with reference to the accompanying drawings, in which embodiments of the inventive subject matter are shown. However, this inventive subject matter should not be construed as being limited to the embodiments set forth herein. Rather, these embodiments are provided so that this disclosure will be thorough and complete, and will fully convey the scope of the inventive subject matter to those skilled in the art. Like numbers refer to like elements throughout. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a layer, region or substrate is referred to herein as being "on", being mounted "on" or extending "onto" another element, it can be directly on or extend directly onto the other element or intervening elements may also be present. In contrast, when an element is referred to herein as being "directly on" or extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element.

The expression "in contact with", as used herein, means that the first structure that is in contact with a second structure is in direct contact with the second structure or is in indirect contact with the second structure. The expression "in indirect contact with" means that the first structure is not in direct contact with the second structure, but that there are a plurality of structures (including the first and second structures), and each of the plurality of structures is in direct contact with at least one other of the plurality of structures (e.g., the first and second structures are in a stack and are separated by one or more intervening layers). The expression "direct contact", as used in the present specification, means that the first structure which is "in direct contact" with a second structure is touching the second structure and there are no intervening structures between the first and second structures at least at some location.

A statement herein that two components in a device are "electrically connected," means that there are no components electrically between the components that affect the function or functions provided by the device. For example, two components can be referred to as being electrically connected, even though they may have a small resistor between them which does not materially affect the function or functions provided by the device (indeed, a wire connecting two components can be thought of as a small resistor); likewise, two components can be referred to as being electrically connected, even though they may have an additional electrical component between them which allows the device to perform an additional function, while not materially affecting the function or functions provided by a device which is identical except for not including the additional component; similarly, two components which are directly connected to each other, or which are directly connected to opposite ends of a wire or a trace on a circuit board, are electrically connected. A statement herein that two components in a device are "electrically connected" is distinguishable from a statement that the two components are "directly electrically connected", which means that there are no components electrically between the two components.

Although the terms "first", "second", etc. may be used herein to describe various elements, components, regions, layers, sections and/or parameters, these elements, components, regions, layers, sections and/or parameters should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive subject matter.

Relative terms, such as "lower", "bottom", "below", "upper", "top" or "above," may be used herein to describe one element's relationship to another elements as illustrated in the Figures. Such relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

The expression "illumination" (or "illuminated"), as used herein when referring to a light source, means that at least some current is being supplied to the light source to cause the light source to emit at least some electromagnetic radiation (e.g., visible light). The expression "illuminated" encompasses situations where the light source emits electromagnetic radiation continuously, or intermittently at a rate such that a human eye would perceive it as emitting light continuously or intermittently, or where a plurality of light sources of the same color or different colors are emitting electromagnetic radiation intermittently and/or alternatingly (with or without overlap in "on" times), e.g., in such a way that a human eye would perceive them as emitting light continuously or intermittently (and, in some cases where different colors are emitted, as separate colors or as a mixture of those colors).

The expression "excited", as used herein when referring to luminescent material, means that at least some electromagnetic radiation (e.g., visible light, UV light or infrared light) is contacting the luminescent material, causing the luminescent material to emit at least some light. The expression "excited" encompasses situations where the luminescent material emits light continuously, or intermittently at a rate such that a human eye would perceive it as emitting light continuously or intermittently, or where a plurality of luminescent materials that emit light of the same color or different colors are emitting light intermittently and/or alternatingly (with or without overlap in "on" times) in such a way that a human eye would perceive them as emitting light continuously or intermittently (and, in some cases where different colors are emitted, as a mixture of those colors).

The expression "lighting device", as used herein, is not limited, except that it indicates that the device is capable of emitting light. That is, a lighting device can be a device which illuminates an area or volume, e.g., a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, or a device or array of devices that illuminate an enclosure, or a device that is used for edge or back-lighting (e.g., back light poster, signage, LCD displays), bulb replacements (e.g., for replacing AC incandescent lights, low voltage lights, fluorescent lights, etc.), lights used for outdoor lighting, lights used for security lighting, lights used for exterior residential lighting (wall mounts, post/column mounts), ceiling fixtures/wall sconces, under cabinet lighting, lamps (floor and/or table and/or desk), landscape lighting, track lighting, task lighting, specialty lighting, ceiling fan lighting, archival/art display lighting, high vibration/impact lighting—work lights, etc., mirrors/vanity lighting, or any other light emitting device.

The present inventive subject matter further relates to an illuminated enclosure (the volume of which can be illuminated uniformly or non-uniformly), comprising an enclosed space and at least one lighting device according to the present inventive subject matter, wherein the lighting device illuminates at least a portion of the enclosed space (uniformly or non-uniformly).

As noted above, some embodiments of the present inventive subject matter comprise at least a first power line, and some embodiments of the present inventive subject matter are directed to a structure comprising a surface and at least one lighting device corresponding to any embodiment of a lighting device according to the present inventive subject matter as described herein, wherein if current is supplied to the first power line, and/or if at least one solid state light emitter in the lighting device is illuminated, the lighting device would illuminate at least a portion of the surface.

The present inventive subject matter is further directed to an illuminated area, comprising at least one item, e.g., selected from among the group consisting of a structure, a swimming pool or spa, a room, a warehouse, an indicator, a road, a parking lot, a vehicle, signage, e.g., road signs, a billboard, a ship, a toy, a mirror, a vessel, an electronic device, a boat, an aircraft, a stadium, a computer, a remote audio device, a remote video device, a cell phone, a tree, a window, an LCD display, a cave, a tunnel, a yard, a lamppost, etc., having mounted therein or thereon at least one lighting device as described herein.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein. It will also be appreciated by those of skill in the art that references to a structure or feature that is disposed "adjacent" another feature may have portions that overlap or underlie the adjacent feature.

As noted above, the present inventive subject matter is directed to a lighting device that comprises a trim element, at least a first light source, and at least a first removable heat sink element.

The trim element can be of any suitable shape and size, and can be made of any suitable material or materials. Representative examples of materials that can be used for making a trim element include, among a wide variety of other materials, spun aluminum, stamped aluminum, die cast aluminum, rolled or stamped steel, hydroformed aluminum, injection molded metal, iron, injection molded thermoplastic, compression molded or injection molded thermoset, glass (e.g., molded glass), ceramic, liquid crystal polymer, polyphenylene sulfide (PPS), clear or tinted acrylic (PMMA) sheet, cast or injection molded acrylic, thermoset bulk molded compound or other composite material. In some embodiments that include a trim element, the trim element can consist of or can comprise a reflective element (and/or one or more of its surfaces can be reflective). Such reflective elements (and surfaces) are well-known and readily available to persons skilled in the art. A representative example of a suitable material out of which a reflective element can be made is a material marketed by Furukawa (a Japanese corporation) under the trademark MCPET®.

In some embodiments according to the present inventive subject matter, the lighting device can further comprise a mixing chamber element (i.e., an element that defines a region in which light emitted by the one or more light sources can mix), or the trim element can comprise a mixing chamber element (e.g., the mixing chamber element can be integral with the trim element, and/or the trim element can comprise a region that functions as a mixing chamber).

In some embodiments, including some embodiments that include or do not include any of the features described above, the trim element has one or more structural features which make it readily possible to attach to the trim element a desired heat sink element or combination of heat sink elements that will provide a desired amount of heat dissipation capability based on the heat generation characteristics of the one or more light sources in the lighting device.

Persons of skill in the art are familiar with, and have ready access to, a wide variety of light sources (of white or any other color), and any suitable light source (or sources) can be employed in the lighting devices according to the present inventive subject matter.

Representative examples of types of light sources include solid state light emitters, incandescent lights, fluorescent lamps, laser diodes, thin film electroluminescent devices, light emitting polymers (LEPs), halogen lamps, high intensity discharge lamps, electron-stimulated luminescence lamps, etc., with or without filters. That is, the at least one light source can comprise a single light source, a plurality of light sources of a particular type, or any combination of one or more light sources of each of a plurality of types.

Each of the one or more light sources can be selected from among any or all of the wide variety of light sources known to persons of skill in the art. That is, the at least one light source can comprise a single light source, two or more light sources of a particular type, or any combination of one or more light sources of each of a plurality of types.

The various types of light sources have been provided in a variety of shapes, sizes and arrangements, e.g., A lamps, B-10 lamps, BR lamps, C-7 lamps, C-15 lamps, ER lamps, F lamps, G lamps, K lamps, MB lamps, MR lamps, PAR lamps, PS lamps, R lamps, S lamps, S-11 lamps, T lamps, Linestra 2-base lamps, AR lamps, ED lamps, E lamps, BT lamps, Linear fluorescent lamps, U-shape fluorescent lamps, circline fluorescent lamps, single twin tube compact fluorescent lamps, double twin tube compact fluorescent lamps, triple twin tube compact fluorescent lamps, A-line compact fluorescent lamps, screw twist compact fluorescent lamps, globe screw base compact fluorescent lamps, reflector screw base compact fluorescent lamps, etc., and any of such shapes, sizes and arrangements (whether listed above or not) can be employed in the lighting devices according to the present inventive subject matter.

The various types of light sources have been designed so as to serve any of a variety of functions (e.g., as a flood light, as a spotlight, as a downlight, etc.), and have been used in residential, commercial or other applications, and light sources serving such functions (or any other suitable function) and/or for such applications (or for any other application) can be employed in the lighting devices according to the present inventive subject matter.

As noted above, one or more of the one or more light source(s) in a lighting device according to the present inventive subject matter can be a solid state light emitter. A variety of solid state light emitters are well known, and any of such light emitters can be employed according to the present inventive subject matter. Representative examples of solid state light emitters include light emitting diodes (inorganic or organic, including polymer light emitting diodes (PLEDs)) with or without luminescent materials.

Persons of skill in the art are familiar with, and have ready access to, a variety of solid state light emitters that emit light having a desired peak emission wavelength and/or dominant emission wavelength, and any of such solid state light emitters (discussed in more detail below), or any combinations of such solid state light emitters, can be employed in embodiments that comprise a solid state light emitter.

Light emitting diodes are semiconductor devices that convert electrical current into light. A wide variety of light emitting diodes are used in increasingly diverse fields for an ever-expanding range of purposes. More specifically, light emitting diodes are semiconducting devices that emit light (ultraviolet, visible, or infrared) when a potential difference is applied across a p-n junction structure. There are a number of well known ways to make light emitting diodes and many associated structures, and the present inventive subject matter can employ any such devices.

A light emitting diode produces light by exciting electrons across the band gap between a conduction band and a valence band of a semiconductor active (light-emitting) layer. The electron transition generates light at a wavelength that depends on the band gap. Thus, the color of the light (wavelength) (and/or the type of electromagnetic radiation, e.g., infrared light, visible light, ultraviolet light, near ultraviolet light, etc., and any combinations thereof) emitted by a light emitting diode depends on the semiconductor materials of the active layers of the light emitting diode.

The expression "light emitting diode" is used herein to refer to the basic semiconductor diode structure (i.e., the chip). The commonly recognized and commercially available "LED" that is sold (for example) in electronics stores typically represents a "packaged" device made up of a number of parts. These packaged devices typically include a semiconductor based light emitting diode such as (but not limited to) those described in U.S. Pat. Nos. 4,918,487; 5,631,190; and 5,912,477; various wire connections, and a package that encapsulates the light emitting diode.

Lighting devices or lighting arrangements according to the present inventive subject matter can, if desired, further comprise one or more luminescent materials.

A luminescent material is a material that emits a responsive radiation (e.g., visible light) when excited by a source of exciting radiation. In many instances, the responsive radiation has a wavelength that is different from the wavelength of the exciting radiation.

Luminescent materials can be categorized as being down-converting, i.e., a material that converts photons to a lower energy level (longer wavelength) or up-converting, i.e., a material that converts photons to a higher energy level (shorter wavelength).

One type of luminescent material are phosphors, which are readily available and well known to persons of skill in the art. Other examples of luminescent materials include scintillators, day glow tapes and inks that glow in the visible spectrum upon illumination with ultraviolet light.

Persons of skill in the art are familiar with, and have ready access to, a variety of luminescent materials that emit light having a desired peak emission wavelength and/or dominant emission wavelength, or a desired hue, and any of such luminescent materials, or any combinations of such luminescent materials, can be employed, if desired.

The one or more luminescent materials can be provided in any suitable form. For example, the luminescent element can be embedded in a resin (i.e., a polymeric matrix), such as a silicone material, an epoxy material, a glass material or a metal oxide material, and/or can be applied to one or more surfaces of a resin, to provide a lumiphor.

The one or more solid state light emitters (and optionally one or more luminescent materials) can be arranged in any suitable way.

Representative examples of suitable solid state light emitters, including suitable light emitting diodes, luminescent materials, lumiphors, encapsulants, etc. that may be used in practicing the present inventive subject matter, are described in:

U.S. patent application Ser. No. 11/614,180, filed Dec. 21, 2006 (now U.S. Patent Publication No. 2007/0236911), the entirety of which is hereby incorporated by reference as if set forth in its entirety;

U.S. patent application Ser. No. 11/624,811, filed Jan. 19, 2007 (now U.S. Patent Publication No. 2007/0170447), the entirety of which is hereby incorporated by reference as if set forth in its entirety;

U.S. patent application Ser. No. 11/751,982, filed May 22, 2007 (now U.S. Patent Publication No. 2007/0274080), the entirety of which is hereby incorporated by reference as if set forth in its entirety;

U.S. patent application Ser. No. 11/753,103, filed May 24, 2007 (now U.S. Patent Publication No. 2007/0280624), the entirety of which is hereby incorporated by reference as if set forth in its entirety;

U.S. patent application Ser. No. 11/751,990, filed May 22, 2007 (now U.S. Patent Publication No. 2007/0274063), the entirety of which is hereby incorporated by reference as if set forth in its entirety;

U.S. patent application Ser. No. 11/736,761, filed Apr. 18, 2007 (now U.S. Patent Publication No. 2007/0278934), the entirety of which is hereby incorporated by reference as if set forth in its entirety;

U.S. patent application Ser. No. 11/936,163, filed Nov. 7, 2007 (now U.S. Patent Publication No. 2008/0106895), the entirety of which is hereby incorporated by reference as if set forth in its entirety;

U.S. patent application Ser. No. 11/843,243, filed Aug. 22, 2007 (now U.S. Patent Publication No. 2008/0084685), the entirety of which is hereby incorporated by reference as if set forth in its entirety;

U.S. Pat. No. 7,213,940, issued on May 8, 2007, the entirety of which is hereby incorporated by reference as if set forth in its entirety;

U.S. Patent Application No. 60/868,134, filed on Dec. 1, 2006, entitled "LIGHTING DEVICE AND LIGHTING METHOD" (inventors: Antony Paul van de Ven and Gerald H. Negley; the entirety of which is hereby incorporated by reference as if set forth in its entirety;

U.S. patent application Ser. No. 11/948,021, filed on Nov. 30, 2007 (now U.S. Patent Publication No. 2008/0130285), the entirety of which is hereby incorporated by reference as if set forth in its entirety;

U.S. patent application Ser. No. 12/475,850, filed on Jun. 1, 2009 (now U.S. Patent Publication No. 2009/0296384), the entirety of which is hereby incorporated by reference as if set forth in its entirety;

U.S. patent application Ser. No. 11/870,679, filed Oct. 11, 2007 (now U.S. Patent Publication No. 2008/0089053), the entirety of which is hereby incorporated by reference as if set forth in its entirety;

U.S. patent application Ser. No. 12/117,148, filed May 8, 2008 (now U.S. Patent Publication No. 2008/0304261), the entirety of which is hereby incorporated by reference as if set forth in its entirety; and U.S. patent application Ser. No. 12/017,676, filed on Jan. 22, 2008 (now U.S. Patent Publication No. 2009/0108269), the entirety of which is hereby incorporated by reference as if set forth in its entirety.

The at least one removable heat sink element can be of any of a variety of shapes and sizes.

The expression "removable", as used herein when referring to one or more heat sink elements, means that the heat sink element (or elements) can be removed from the lighting device without severing any material, e.g., by loosening or removing one or more screws or bolts and removing the heat sink element (or elements) from the lighting device (and in some cases replacing it with a heat sink element having different heat sink capabilities).

In some embodiments, including some embodiments that include or do not include any of the features described above, one or more heat sink elements can be selected so as to provide a desired rate of heat dissipation under specific circumstances (e.g., when all of the light sources in the lighting device being fully illuminated and after thermal equilibrium has been reached, and under typical air flow conditions).

In some embodiments, including some embodiments that include or do not include any of the features described above, at least one heat sink element is provided that can readily be removed and/or replaced, e.g., if testing reveals that slightly more heat dissipation is needed or slightly less heat dissipation is needed.

In some embodiments, including some embodiments that include or do not include any of the features described above, at least one heat sink element is provided that is of a shape that has a readily identifiable number of sub-regions.

In some embodiments, including some embodiments that include or do not include any of the features described above, at least a first heat sink element is provided that can readily be stacked with one or more other heat sink element that has at least a portion that is similar in shape to at least a corresponding portion of the first heat sink element.

In some embodiments, including some embodiments that include or do not include any of the features described above, a space is provided in which one or more heat sink elements can be positioned.

In some embodiments, including some embodiments that include or do not include any of the features described above, a plurality of heat sink elements can be provided so that a desired heat sink element or combination of heat sink elements can be selected and attached to the lighting device in order to provide a desired amount of heat dissipation capability based on the heat generation characteristics of the one or more light sources in the lighting device.

In some instances, it is desirable that the lighting device not provide substantially more heat dissipation capability than is necessary or desired, e.g., in order to reduce or minimize materials usage (and associated cost) and/or to reduce or minimize the weight of the lighting device.

In some embodiments of the present inventive subject matter, including some embodiments that include or do not include any of the features described above, the first heat sink element comprises at least a first inner region and at least a first outer region, locations on the first inner region of the first heat sink element being closer to an axis of the trim element than locations on the first outer region of the first heat sink element.

The expression "axis of the trim element" (and the like), as used herein, can refer to a straight line about which the trim element is substantially symmetrical. In instances where a trim element is not substantially symmetrical about any line, the expression "axis of the trim element" can refer to (1) a line relative to which two or more like structures (or structures that provide like functions) on the trim element are equidistant, (2) a line that passes through a center of gravity of the trim element, and/or (3) a line about which rotation of the trim element would be substantially balanced.

The expression "substantially symmetrical", as used herein, when referring to a shape, means that the shape is symmetrical or could be made symmetrical by removing a specific region or regions which in total comprise not more than about 10 percent of its volume and/or by adding a specific region or regions which in total comprise not more than about 10 percent of its volume.

The expression "substantially balanced", as used herein, when referring to a structure, means that the structure is balanced or could be balanced by adding to a specific location or locations mass that in total comprises not more than about 10 percent of the mass of the structure.

In some of such embodiments:

- the lighting device comprises at least the first removable heat sink element and a second removable heat sink element,
- the second heat sink element comprises at least a first inner region and at least a first outer region, locations on the first inner region of the second heat sink element being closer to the axis of the trim element than locations on the first outer region of the second heat sink element, and
- a contact portion of the first inner region of the first heat sink element is in contact with a contact portion of the first inner region of the second heat sink element.

In some of these embodiments:

- the first outer region of the first heat sink element has a first angle of inclination relative to the axis of the trim element,
- the first outer region of the second heat sink element has a second angle of inclination relative to the axis of the trim element, and
- the first angle of inclination differs from the second angle of inclination by at least 15 degrees.

The expression "angle of inclination" as used herein when referring to the orientation of a first structure relative to an axis of a second structure (e.g., "the angle of inclination of the first outer region of the first heat sink element relative to the axis of the trim element"), means the angle that an axis of substantial symmetry of the first structure makes relative to a first plane that is perpendicular to the axis of the second structure, in which the angle is:

- positive if, as the axis of substantial symmetry moves farther away from the axis of the second structure, it intersects with planes perpendicular to the axis of the second structure above the first plane (or on one side of the first plane), and is
- negative if, as the axis of substantial symmetry moves farther away from the axis of the second structure, it intersects with planes perpendicular to the axis of the second structure below the first plane (or on the other side of the first plane).

In other words, if the axis of the trim element is considered to be vertical (or if the lighting device is oriented such that it is vertical), if the axis of substantial symmetry goes higher as it moves away from the axis of the trim element, the angle of inclination is positive; and if the axis of substantial symmetry goes lower as it moves away from the axis of the trim element, the angle of inclination is negative.

The expression "axis of substantial symmetry", as used herein, when referring to a structure (e.g., "axis of substantial symmetry of the first outer region of the first heat sink element") can refer to a straight line about which the structure is substantially symmetrical. In instances where the structure is not substantially symmetrical about any line, the expression "axis of substantial symmetry" can refer to (1) a line relative to which two or more like sub-structures (or structures that provide like functions) are equidistant, (2) a line that passes through a center of gravity of the structure, and/or (3) a line about which rotation of the structure would be substantially balanced.

The expression "plane of substantial symmetry", as used herein, when referring to a structure (e.g., "plane of substantial symmetry of the first outer region of the first heat sink element") can refer to a plane relative to which the structure is substantially symmetrical. In instances where the structure is not substantially symmetrical relative to any plane, the expression "plane of substantial symmetry" can refer to (1) a plane relative to which two or more like sub-structures (or structures that provide like functions) are equidistant, (2) a plane in which the mass of the structure on opposite sides of the plane is substantially the same (3) a plane that passes through a center of gravity of the structure, and/or (4) a plane that is perpendicular to a line about which rotation of the structure would be substantially balanced and on which the mass of the structure on opposite sides of the plane is substantially the same.

The expression "substantially the same" when referring to first and second values means that the first value is between 0.90 to 1.10 times the second value In some embodiments of the present inventive subject matter, including some embodiments that include or do not include any of the features described above:

- the first heat sink element comprises at least a first inner region and a plurality of outer regions, locations on the first inner region of the first heat sink element being closer to an axis of the trim element than locations on the outer regions of the first heat sink element,
- the lighting device comprises at least the first removable heat sink element and a second removable heat sink element,
- the second heat sink element comprises at least a first inner region and a plurality of outer regions, locations on each of the outer regions of the second heat sink element being farther from the axis of the trim element than locations on the first inner region of the second heat sink element,
- a contact portion of the first inner region of the first heat sink element is in contact with a contact portion of the first inner region of the second heat sink element.

In some of such embodiments, angles of inclination of each of at least three outer regions of the second heat sink element differ by at least about 15 degrees from each angle of inclination of at least three outer regions of the first heat sink element.

In some embodiments of the present inventive subject matter, including some embodiments that include or do not include any of the features described above:

- the first heat sink element comprises at least a first inner region and at least a first outer region, locations on the first inner region of the first heat sink element being closer to an axis of the trim element than locations on the first outer region of the first heat sink element, and an axis of substantial symmetry of the first outer region of the first heat sink element passes within a distance from the axis of the trim element which is not greater than one-third of a dimension of the first outer region of the first heat sink element in a direction along the axis of substantial symmetry of the first outer region of the first sink element.

In some embodiments of the present inventive subject matter, including some embodiments that include or do not include any of the features described above:

the first heat sink element comprises at least a first inner region and at least a first outer region, locations on the first inner region of the first heat sink element being closer to an axis of the trim element than locations on the first outer region of the first heat sink element, the lighting device comprises at least three heat sink elements including the first removable heat sink element, a second removable heat sink element and a third removable heat sink element, the first outer region of the first heat sink element has a first angle of inclination relative to the axis of the trim element, a first outer region of the second heat sink element has a second angle of inclination relative to the axis of the trim element, a first outer region of the third heat sink element has a third angle of inclination relative to the axis of the trim element, the first angle of inclination differs from the second angle of inclination by at least about 15 degrees, the first angle of inclination differs from the third angle of inclination by at least about 15 degrees, and the second angle of inclination differs from the third angle of inclination by at least about 15 degrees.

In some of such embodiments:

the first heat sink element has at least three outer regions, including the first outer region of the first heat sink element, a second outer region of the first heat sink element and a third outer region of the first heat sink element, the first outer region of the first heat sink element has a first angle of inclination relative to the axis of the trim element, the second outer region of the first heat sink element has a second angle of inclination relative to the axis of the trim element, the third outer region of the first heat sink element has a third angle of inclination relative to the axis of the trim element, the first angle of inclination is equal to or differs from the second angle of inclination by not more than about 5 degrees, the first angle of inclination is equal to or differs from the third angle of inclination by not more than about 5 degrees, the second angle of inclination is equal to or differs from the third angle of inclination by not more than about 5 degrees, a first plane of substantial symmetry of the first outer region of the first heat sink element, which first plane encompasses the axis of the trim element, defines an angle of at least 15 degrees relative to a second plane of substantial symmetry of the second outer region of the first heat sink element, which second plane encompasses the axis of the trim element, the first plane of substantial symmetry defines an angle of at least 15 degrees relative to a third plane of substantial symmetry of the third outer region of the first heat sink element, which third plane encompasses the axis of the trim element, the second plane of substantial symmetry defines an angle of at least 15 degrees relative to the third plane of substantial symmetry.

In some embodiments of the present inventive subject matter, including some embodiments that include or do not include any of the features described above:

the first heat sink element comprises at least a first inner region and at least first, second and third outer regions, locations on the first inner region of the first heat sink element being closer to an axis of the trim element than locations on the first, second and third outer regions of the first heat sink element, the first outer region of the first heat sink element has a first angle of inclination relative to the axis of the trim element, the second outer region of the first heat sink element has a second angle of inclination relative to the axis of the trim element, the third outer region of the first heat sink element has a third angle of inclination relative to the axis of the trim element, the first angle of inclination is equal to or differs from the second angle of inclination by not more than about 5 degrees, the first angle of inclination is equal to or differs from the third angle of inclination by not more than about 5 degrees, the second angle of inclination is equal to or differs from the third angle of inclination by not more than about 5 degrees, a first plane of substantial symmetry of the first outer region of the first heat sink element, which first plane encompasses the axis of the trim element, defines an angle of at least 15 degrees relative to a second plane of substantial symmetry of the second outer region of the first heat sink element, which second plane encompasses the axis of the trim element, the first plane of substantial symmetry defines an angle of at least 15 degrees relative to a third plane of substantial symmetry of the third outer region of the first heat sink element, which third plane encompasses the axis of the trim element, the second plane of substantial symmetry defines an angle of at least 15 degrees relative to the third plane of substantial symmetry.

The one or more heat sink elements provided in any particular lighting device according to the present inventive subject matter can collectively be referred to as the "thermal management system" for the lighting device.

Any one or more regions of the one or more heat sink elements provided in any thermal management system for a lighting device according to the present inventive subject matter can be integral with any or all of the other regions of the one or more heat sink elements and/or can be attached to any or all of the other regions of the one or more heat sink elements (e.g., by adhesive, bolts, screws, rivets, etc.). Furthermore, multiple heat sink elements may be provided as part of a unitary structure, as individual structures or as any suitable combination of unitary and combined structures.

In some embodiments of the present inventive subject matter, including some embodiments that include or do not include any of the features described above, the lighting device further comprises a driver sub-assembly, and at least the first removable heat sink element is positioned between a portion of the driver sub-assembly and a portion of the trim element, e.g., in some embodiments, the first heat sink element (or a plurality of heat sink elements) can be sandwiched between a driver sub-assembly and the trim element.

A driver sub-assembly can comprise any suitable components of a lighting device, or it can comprise just a portion of a trim element. For instance, in some embodiments of the present inventive subject matter, the driver sub-assembly can comprise any of (1) an electrical connector (e.g., an Edison plug or GU24 pins), (2) one or more electrical components employed in converting electrical power (e.g., from AC to DC and/or from one voltage to another voltage), (3) one or more electrical components employed in driving one or more light source, e.g., running one or more light source intermittently and/or adjusting the current supplied to one or more light sources in response to a user command, a detected change in intensity or color of light output, a detected change in an ambient characteristic such as temperature or background light, etc., and/or a signal contained in the input power (e.g., a dimming signal in AC power supplied to the lighting device), etc., (4) one or more circuit boards (e.g., a metal core circuit board) for supporting and/or providing current to any electrical components, (5) one or more wires connecting any components (e.g., connecting an Edison socket to a circuit board), etc.

In some embodiments of the present inventive subject matter, including some embodiments that include or do not include any of the features described above:

- the lighting device further comprises a driver sub-assembly,
- the lighting device comprises at least two heat sink elements, including at least the first removable heat sink element and a second removable heat sink element, and
- at least the first removable heat sink element and the second removable heat sink element are positioned between a portion of the driver sub-assembly and a portion of the trim element.

In some embodiments of the present inventive subject matter, including some embodiments that include or do not include any of the features described above, a shape of the first removable heat sink element and a shape of a second removable heat sink element are substantially the same shape, with the second removable heat sink element being rotated about the axis of the trim element at least five degrees relative to the first removable heat sink element.

The expression "substantially the same shape", when referring to a first shape and a second shape, means that the first shape could be made to be identical to the second shape by removing from the first shape a specific region or regions which in total comprise not more than about 10 percent of its volume (or area) and/or by adding a specific region or regions which in total comprise not more than about 10 percent of its volume (or area) and, if necessary, magnifying one of the shapes.

In some embodiments of the present inventive subject matter, including some embodiments that include or do not include any of the features described above:

- the lighting device further comprises a driver sub-assembly and at least a first spacer element, and
- the first spacer element is positioned between the trim element and the driver sub-assembly.

In some of such embodiments, a space is defined between the trim element and the driver sub-assembly, and at least 60 percent of the volume in the space is vacant.

The term "space", as used in the expression "a space is defined between the trim element and the driver sub-assembly" means that every location in the space is along at least one line segment connecting a location on the driver sub-assembly and a location on the trim element (and in some embodiments, it means that every location in the space is along at least one line segment connecting a location on the driver sub-assembly and a location on the trim element that is nearest to such location on the driver sub-assembly).

A statement that a location is "vacant" as used herein, e.g., in a statement that at least some percentage of the volume in the space is "vacant", means that no solid material is present (e.g., no portion of the trim element, the heat sink element(s), the driver sub-assembly, etc.).

In some of such embodiments, a space is defined between the trim element and the driver sub-assembly, and the lighting device further comprises at least a first removable heat sink structure, at least a portion of the first removable heat sink structure being positioned in the space.

In some embodiments of the present inventive subject matter, including some embodiments that include or do not include any of the features described above, at least a first portion of the first removable heat sink element is in thermal contact with at least a first portion of a first surface of the trim element.

In some of such embodiments:

- the first portion of the first removable heat sink element is positioned between the first light source and the first portion of the trim element,
- the first portion of the first surface of the trim element is positioned between the first light source and the first portion of the first removable heat sink element, and/or
- the first portion of the first removable heat sink element includes locations that are included in respective planes that are perpendicular to the axis of the trim element and that are spaced from each other.

The first heat sink element (and any additional heat sink elements) can be made from any suitable material or combination of materials, a wide variety of which will be apparent to persons skilled in the art. In lighting devices that comprise more than one heat sink element, any of the different heat sink elements can be made of differing materials or combinations of materials.

Representative examples of materials that can be employed in making heat sink elements include, for example, materials that inherently have high thermal conductivities, such as metals, metal alloys, ceramics, and polymers mixed with ceramic or metal or metalloid particles. One of the more common materials is aluminum.

The expression "after thermal equilibrium has been reached" refers to supplying current to one or more light sources in a lighting device to allow the light source(s) and other surrounding structures to heat up to (or near to) a temperature to which they will typically be heated when the lighting device is illuminated. The particular duration that current should be supplied will depend on the particular configuration of the lighting device. For example, the greater the thermal mass, the longer it will take for the light source(s) to approach their thermal equilibrium operating temperature. While a specific time for operating the lighting device prior to reaching thermal equilibrium may be lighting device specific, in some embodiments, durations of from about 1 to about 60 minutes or more and, in specific embodiments, about 30 minutes, may be used. In some instances, thermal equilibrium is reached when the temperature of the light source (or each of the light sources) does not vary substantially (e.g., more than 2 degrees C.) without a change in ambient or operating conditions.

In many situations, the lifetime of light sources, e.g., solid state light emitters, can be correlated to a thermal equilibrium temperature (e.g., junction temperatures of solid state light emitters). The correlation between lifetime and junction temperature may differ based on the manufacturer (e.g., in the case of solid state light emitters, Cree, Inc., Philips-Lumileds, Nichia, etc). The lifetimes are typically rated as thousands of hours at a particular temperature (junction temperature in the case of solid state light emitters). Thus, in particular embodiments, the component or components of the thermal management system of the lighting device is/are selected so as to extract heat from the light source(s) and dissipate the extracted heat to a surrounding environment at such a rate that a temperature is maintained at or below a particular temperature (e.g., to maintain a junction temperature of a solid state light emitter at or below a 25,000 hour rated lifetime junction temperature for the solid state light source in a 25° C. surrounding environment, in some embodiments, at or below a 35,000 hour rated lifetime junction temperature, in further embodiments, at or below a 50,000 hour rated lifetime junction temperature, or other hour values, or in other embodiments, analogous hour ratings where the surrounding temperature is 35° C. (or any other value).

Heat transfer from one structure or region to another can be enhanced (i.e., thermal resistivity can be reduced or minimized) using any suitable material or structure for doing so, a variety of which are known to persons of skill in the art, e.g., by means of chemical or physical bonding and/or by interposing a heat transfer aid such as a thermal pad, thermal grease, graphite sheets, etc.

In some embodiments according to the present inventive subject matter, a portion (or portions) of any of the one or more heat sink elements (or other element or elements) can comprise one or more thermal transfer region(s) that has/have an elevated heat conductivity (e.g., higher than the rest of that heat sink element or other element). A thermal transfer region (or regions) can be made of any suitable material, and can be of any suitable shape. Use of materials having higher heat conductivity in making the thermal transfer region(s) generally provides greater heat transfer, and use of thermal transfer region(s) of larger surface area and/or cross-sectional area generally provides greater heat transfer. Representative examples of materials that can be used to make the thermal transfer region(s), if provided, include metals, diamond, DLC, etc. Representative examples of shapes in which the thermal transfer region(s), if provided, can be formed include bars, slivers, slices, crossbars, wires and/or wire patterns. A thermal transfer region (or regions), if included, can also function as one or more pathways for carrying electricity, if desired.

Some embodiments in accordance with the present inventive subject matter include one or more lenses or diffusers. Persons of skill in the art are familiar with a wide variety of lenses and diffusers, can readily envision a variety of materials out of which a lens or a diffuser can be made, and are familiar with and/or can envision a wide variety of shapes that lenses and diffusers can be. Any of such materials and/or shapes can be employed in a lens and/or a diffuser in an embodiment that includes a lens and/or a diffuser. As will be understood by persons skilled in the art, a lens or a diffuser in a lighting device according to the present inventive subject matter can be selected to have any desired effect on incident light (or no effect), such as focusing, diffusing, etc.

In embodiments in accordance with the present inventive subject matter that include a diffuser (or plural diffusers), the diffuser (or diffusers) can be positioned in any suitable location and orientation.

In embodiments in accordance with the present inventive subject matter that include a lens (or plural lenses), the lens (or lenses) can be positioned in any suitable location and orientation.

In addition, one or more scattering elements (e.g., layers) can optionally be included in the lighting devices according to this aspect of the present inventive subject matter. The scattering element can be included in a lumiphor, and/or a separate scattering element can be provided. A wide variety of separate scattering elements and combined luminescent and scattering elements are well known to those of skill in the art, and any such elements can be employed in the lighting devices of the present inventive subject matter.

Some embodiments in accordance with the present inventive subject matter include one or more mixing chamber element, which defines at least a portion of a mixing chamber in which light from one or more light sources is mixed before exiting the lighting device. A mixing chamber element, when included, can be of any suitable shape and size, and can be made of any suitable material or materials. Representative examples of materials that can be used for making a mixing chamber element include, among a wide variety of other materials, spun aluminum, stamped aluminum, die cast aluminum, rolled or stamped steel, hydroformed aluminum, injection molded metal, injection molded thermoplastic, compression molded or injection molded thermoset, molded glass, liquid crystal polymer, polyphenylene sulfide (PPS), clear or tinted acrylic (PMMA) sheet, cast or injection molded acrylic, thermoset bulk molded compound or other composite material. In some embodiments that include a mixing chamber element, the mixing chamber element can consist of or can comprise a reflective element (and/or one or more of its surfaces can be reflective) . Such reflective elements (and surfaces) are well-known and readily available to persons skilled in the art. A representative example of a suitable material out of which a reflective element can be made is a material marketed by Furukawa (a Japanese corporation) under the trademark MCPET®. In some embodiments that include a mixing chamber, the mixing chamber is defined (at least in part) by a mixing chamber element and a lens and/or diffuser.

In some embodiments that include a mixing chamber, the mixing chamber is defined (at least in part) by the trim element (e.g., instead of or in addition to a mixing chamber element). That is, in some embodiments, the trim element defines the entirety of the mixing chamber element (i.e., the mixing chamber element is part of the trim element or the mixing chamber element and the trim element are one and the same) In some embodiments that include a mixing chamber, the mixing chamber is defined (at least in part) by the trim element, along with a mixing chamber element, a lens and/or a diffuser.

The lighting devices of the present inventive subject matter can be arranged in generally any suitable orientation, a variety of which are well known to persons skilled in the art. For example, the lighting device can be a back-reflecting device or a front-emitting device.

Any desired circuitry (including any desired electronic components) can be employed in order to supply energy to the one or more light sources according to the present inventive subject matter. Representative examples of circuitry which may be used in practicing the present inventive subject matter is described in:

U.S. patent application Ser. No. 11/626,483, filed Jan. 24, 2007 (now U.S. Patent Publication No. 2007/0171145), the entirety of which is hereby incorporated by reference as if set forth in its entirety;

U.S. patent application Ser. No. 11/755,162, filed May 30, 2007 (now U.S. Patent Publication No. 2007/0279440), the entirety of which is hereby incorporated by reference as if set forth in its entirety;

U.S. patent application Ser. No. 11/854,744, filed Sep. 13, 2007 (now U.S. Patent Publication No. 2008/0088248), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/328,144, filed Dec. 4, 2008 (now U.S. Patent Publication No. 2009/0184666), the entirety of which is hereby incorporated by reference as if set forth in its entirety;

U.S. patent application Ser. No. 12/328,115, filed on Dec. 4, 2008 (now U.S. Patent Publication No. 2009-0184662), the entirety of which is hereby incorporated by reference as if set forth in its entirety;

U.S. patent application Ser. No. 12/566,142, filed on Sep. 24, 2009, entitled "Solid State Lighting Apparatus With Configurable Shunts" (now U.S. Patent Publication No. 2011/0068696), the entirety of which is hereby incorporated by reference as if set forth in its entirety; and U.S. patent application Ser. No. 12/566,195, filed on Sep. 24, 2009, entitled "Solid State Lighting Apparatus With Controllable Bypass Circuits And Methods Of Operation Thereof", now U.S. Patent Publication No. 2011/0068702); 5308-1128), the entirety of which is hereby incorporated by reference as if set forth in its entirety.

For example, solid state lighting systems have been developed that include a power supply that receives the AC line voltage and converts that voltage to a voltage (e.g., to DC and to a different voltage value) and/or current suitable for driving solid state light emitters. Typical power supplies for light emitting diode light sources include linear current regulated supplies and/or pulse width modulated current and/or voltage regulated supplies. In some embodiments of lighting devices according to the present inventive subject matter, a power supply can be provided in a driver sub-assembly. In some embodiments of lighting devices according to the present inventive subject matter, a power supply can be provided in the trim element. In some embodiments of lighting devices according to the present inventive subject matter, a power supply can be provided elsewhere, i.e., not in the trim element and not in a driver sub-assembly (e.g., not in the lighting device). In some embodiments of lighting devices according to the present inventive subject matter, some components of a power supply can be provided in a driver sub-assembly, and other components of a power supply can be provided in the trim element.

Many different techniques have been described for driving solid state light sources in many different applications, including, for example, those described in U.S. Pat. No. 3,755,697 to Miller, U.S. Pat. No. 5,345,167 to Hasegawa et al, U.S. Pat. No. 5,736,881 to Ortiz, U.S. Pat. No. 6,150,771 to Perry, U.S. Pat. No. 6,329,760 to Bebenroth, U.S. Pat. No. 6,873,203 to Latham, II et al, U.S. Pat. No. 5,151,679 to Dimmick, U.S. Pat. No. 4,717,868 to Peterson, U.S. Pat. No. 5,175,528 to Choi et al, U.S. Pat. No. 3,787,752 to Delay, U.S. Pat. No. 5,844,377 to Anderson et al, U.S. Pat. No. 6,285,139 to Ghanem, U.S. Pat. No. 6,161,910 to Reisenauer et al, U.S. Pat. No. 4,090,189 to Fisler, U.S. Pat. No. 6,636,003 to Rahm et al, U.S. Pat. No. 7,071,762 to Xu et al, U.S. Pat. No. 6,400,101 to Biebl et al, U.S. Pat. No. 6,586,890 to Min et al, U.S. Pat. No. 6,222,172 to Fossum et al, U.S. Pat. No. 5,912,568 to Kiley, U.S. Pat. No. 6,836,081 to Swanson et al, U.S. Pat. No. 6,987,787 to Mick, U.S. Pat. No. 7,119,498 to Baldwin et al, U.S. Pat. No. 6,747,420 to Barth et al, U.S. Pat. No. 6,808,287 to Lebens et al, U.S. Pat. No. 6,841,947 to Berg-johansen, U.S. Pat. No. 7,202,608 to Robinson et al, U.S. Pat. No. 6,995,518, U.S. Pat. No. 6,724,376, U.S. Pat. No. 7,180,487 to Kamikawa et al, U.S. Pat. No. 6,614,358 to Hutchison et al, U.S. Pat. No. 6,362,578 to Swanson et al, U.S. Pat. No. 5,661,645 to Hochstein, U.S. Pat. No. 6,528,954 to Lys et al, U.S. Pat. No. 6,340,868 to Lys et al, U.S. Pat. No. 7,038,399 to Lys et al, U.S. Pat. No. 6,577,072 to Saito et al, and U.S. Pat. No. 6,388,393 to Illingworth.

Various types of electrical connectors are well known to those skilled in the art, and any of such electrical connectors can be used in the lighting devices according to the present inventive subject matter. Representative examples of suitable types of electrical connectors include Edison plugs (which are receivable in Edison sockets) and GU24 pins (which are receivable in GU24 sockets).

The electrical connector, when included, can be electrically connected to the first light source (or to at least one of the light sources) in any suitable way. A representative example of a way to electrically connect a light source to an electrical connector is to connect a first portion of a flexible wire to the electrical connector and to connect a second portion of the flexible wire to a circuit board (e.g., a metal core circuit board) on which the first light source (or a plurality of light sources) is mounted.

Some embodiments in accordance with the present inventive subject matter can comprise a power line that can be connected to a source of power (such as a branch circuit, a battery, a photovoltaic collector, etc.) and that can supply power to an electrical connector (or directly to the lighting device). Persons of skill in the art are familiar with, and have ready access to, a variety of structures that can be used as a power line. A power line can be any structure that can carry electrical energy and supply it to an electrical connector on a fixture element and/or to a lighting device according to the present inventive subject matter.

Some embodiments in accordance with the present inventive subject matter can employ at least one temperature sensor. Persons of skill in the art are familiar with, and have ready access to, a variety of temperature sensors (e.g., thermistors), and any of such temperature sensors can be employed in embodiments in accordance with the present inventive subject matter. Temperature sensors can be used for a variety of purposes, e.g., to provide feedback information to current adjusters, as described in U.S. patent application Ser. No. 12/117,280, filed May 8, 2008 (now U.S. Patent Publication No. 2008/0309255), the entirety of which is hereby incorporated by reference as if set forth in its entirety.

Energy can be supplied to the lighting devices according to the present inventive subject matter from any source or combination of sources, for example, the grid (e.g., line voltage), one or more batteries, one or more photovoltaic energy collection device (i.e., a device that includes one or more photovoltaic cells that convert energy from the sun into electrical energy), one or more windmills, etc.

The various components in the lighting devices can be mounted in any suitable way. For example, in some embodiments, light emitting diodes can be mounted on a first circuit board (a "light emitting diode circuit board") and electronic circuitry that can convert AC line voltage into DC voltage suitable for being supplied to light emitting diodes can be mounted on a second circuit board (a "driver circuit board"), whereby line voltage is supplied to the electrical connector and passed along to the driver circuit board, the line voltage is converted to DC voltage suitable for being supplied to light emitting diodes in the driver circuit board, and the DC voltage is passed along to the light emitting diode circuit board where it is then supplied to the light emitting diodes. In some embodiments according to the present inventive subject matter, the first circuit board is a metal core circuit board.

The present inventive subject matter is also directed to lighting devices that may further comprise a fixture element. The fixture element can comprise a housing, a mounting structure, and/or an enclosing structure. Persons of skill in the art are familiar with, and can envision, a wide variety of materials out of which a fixture element, a housing, a mounting structure and/or an enclosing structure can be constructed, and a wide variety of shapes for such a fixture element, a housing, a mounting structure and/or an enclosing structure. A fixture element, a housing, a mounting structure and/or an enclosing structure made of any of such materials and having any of such shapes can be employed in accordance with the present inventive subject matter.

For example, fixture elements, housings, mounting structures and enclosing structures, and components or aspects thereof, that may be used in practicing the present inventive subject matter are described in:

U.S. patent application Ser. No. 11/613,692, filed Dec. 20, 2006 (now U.S. Patent Publication No. 2007/0139923), the entirety of which is hereby incorporated by reference as if set forth in its entirety;

U.S. patent application Ser. No. 11/743,754, filed May 3, 2007 (now U.S. Patent Publication No. 2007/0263393), the entirety of which is hereby incorporated by reference as if set forth in its entirety;

U.S. patent application Ser. No. 11/755,153, filed May 30, 2007 (now U.S. Patent Publication No. 2007/0279903), the entirety of which is hereby incorporated by reference as if set forth in its entirety;

U.S. patent application Ser. No. 11/856,421, filed Sep. 17, 2007 (now U.S. Patent Publication No. 2008/0084700), the entirety of which is hereby incorporated by reference as if set forth in its entirety;

U.S. patent application Ser. No. 11/859,048, filed Sep. 21, 2007 (now U.S. Patent Publication No. 2008/0084701), the entirety of which is hereby incorporated by reference as if set forth in its entirety;

U.S. patent application Ser. No. 11/939,047, filed Nov. 13, 2007 (now U.S. Patent Publication No. 2008/0112183), the entirety of which is hereby incorporated by reference as if set forth in its entirety;

U.S. patent application Ser. No. 11/939,052, filed Nov. 13, 2007 (now U.S. Patent Publication No. 2008/0112168), the entirety of which is hereby incorporated by reference as if set forth in its entirety;

U.S. patent application Ser. No. 11/939,059, filed Nov. 13, 2007 (now U.S. Patent Publication No. 2008/0112170), the entirety of which is hereby incorporated by reference as if set forth in its entirety;

U.S. patent application Ser. No. 11/877,038, filed Oct. 23, 2007 (now U.S. Patent Publication No. 2008/0106907), the entirety of which is hereby incorporated by reference as if set forth in its entirety;

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams; the entirety of which is hereby incorporated by reference as if set forth in its entirety;

U.S. patent application Ser. No. 11/948,041, filed Nov. 30, 2007 (now U.S. Patent Publication No. 2008/0137347), the entirety of which is hereby incorporated by reference as if set forth in its entirety;

U.S. patent application Ser. No. 12/114,994, filed May 5, 2008 (now U.S. Patent Publication No. 2008/0304269), the entirety of which is hereby incorporated by reference as if set forth in its entirety;

U.S. patent application Ser. No. 12/116,341, filed May 7, 2008 (now U.S. Patent Publication No. 2008/0278952), the entirety of which is hereby incorporated by reference as if set forth in its entirety;

U.S. patent application Ser. No. 12/277,745, filed on Nov. 25, 2008 (now U.S. Patent Publication No. 2009-0161356), the entirety of which is hereby incorporated by reference as if set forth in its entirety;

U.S. patent application Ser. No. 12/116,346, filed May 7, 2008 (now U.S. Patent Publication No. 2008/0278950), the entirety of which is hereby incorporated by reference as if set forth in its entirety;

U.S. patent application Ser. No. 12/116,348, filed on May 7, 2008 (now U.S. Patent Publication No. 2008/0278957), the entirety of which is hereby incorporated by reference as if set forth in its entirety;

U.S. patent application Ser. No. 12/512,653, filed on Jul. 30, 2009 (now U.S. Patent Publication No. 2010/0102697), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety; and U.S. patent application Ser. No. 12/469,828, filed on May 21, 2009 (now U.S. Patent Publication No. 2010/0103678), the entirety of which is hereby incorporated by reference as if set forth in its entirety.

In some embodiments, the fixture element further comprises an electrical connector that engages the electrical connector on the lighting device, e.g., the electrical connector connected to the fixture element is complementary to the electrical connector connected to the lighting device (for example, the fixture element can comprise an Edison socket into which an Edison plug on the lighting device is receivable, the fixture element can comprise a GU24 socket into which GU24 pins on the lighting device are receivable, etc.).

In some embodiments, the electrical connector that engages the electrical connector on the lighting device is substantially non-moving relative to the fixture element, e.g., the force normally employed when installing an Edison plug in an Edison socket does not cause the Edison socket to move more than one centimeter relative to the housing, and in some embodiments, not more than ½ centimeter (or not more than ¼ centimeter, or not more than one millimeter, etc.). In some embodiments, the electrical connector that engages the electrical connector on the lighting device can move relative to the fixture element and structure can be provided to limit movement of the lighting device relative to the fixture element (e.g., as disclosed in U.S. patent application Ser. No. 11/877,038, filed Oct. 23, 2007 (now U.S. Patent Publication No. 2008/0106907), the entirety of which is hereby incorporated by reference as if set forth in its entirety).

In some embodiments, one or more structures can be attached to the lighting device which engage structure in the fixture element to hold the lighting device in place relative to the fixture element. In some embodiments, the lighting device can be biased against the fixture element, e.g., so that a flange portion of the trim element is maintained in contact (and forced against) a bottom region of the fixture element (e.g., a circular extremity of a can light housing). For example, some embodiments include one or more spring retainer clips (sometimes referred to as "chicken claws") which comprise at least first and second spring-loaded arms (attached to the trim element) and at least one engagement element (attached to the fixture element), the first and second spring loaded arms being spring biased apart from each other (or toward each other) into contact with opposite sides of the engagement element, creating friction which holds the trim element in position relative to the fixture element, while permitting the trim element to be moved to different positions relative to the fixture element. The spring-loaded arms can be spring-biased apart from each other (e.g., into contact with opposite sides of a generally C-shaped engagement element), or they can be spring-biased toward each other (e.g., into contact with opposite sides of a block-shaped engagement element). In some embodiments, the spring-loaded arms can have a hook at a remote location, which can prevent the lighting device from being moved away from the fixture element beyond a desired extreme location (e.g., to prevent the lighting device from falling out of the fixture element).

Another example of a structure that can be used to hold a lighting device in place relative to a fixture element is a telescoping element, i.e., an element that has at least first and second sections that telescope relative to each other, the trim element being connected to the first section, the second section being connected to the fixture element.

Another example of a structure that can be used to hold a lighting device in place relative to a fixture element is an axial spring, where the trim element is connected to a first region of the axial spring and a second region of the axial spring is connected to the fixture element. In some embodiments, the trim element can be attached (via an axial spring) to a first region of the fixture element, and the trim element can be biased by the axial spring into engagement with a second region of the fixture element (e.g., a circular lowermost edge of a cylindrical can) or with a construction element to which the fixture element is attached (e.g., a lower flange of the trim element can be biased by the axial spring upward into engagement with a ceiling in which the fixture element is mounted).

Another example of a structure that can be used to hold a lighting device in place relative to a fixture element is a ratcheting element in which a ratcheting portion can be pushed in a first direction relative to a ratcheting receptacle but not in an opposite direction, the trim element is connected to one of the ratcheting portion and the ratcheting receptacle, and the fixture element is connected to the other of the ratcheting portion and the ratcheting receptacle, whereby the trim element can be incrementally moved in one direction (but not the other direction) relative to the fixture element.

Another example of a structure that can be used to hold a lighting device in place relative to a fixture element is a retracting reel, in which a reel is spring biased to rotate in a direction in which it would wind up a cable, one of the trim element and the fixture element is connected to the reel and the cable is connected to the other of the trim element and the fixture element, whereby the structure connected to the cable can be moved away from the other structure by a force which causes the cable to wind out of the reel, and the spring bias of the reel biases the trim element and the fixture element toward each other (for instance, the trim can be biased by the reel upward into engagement with a ceiling in which the fixture element is mounted).

The lighting devices according to the present inventive subject matter can further comprise elements that help to ensure that the perceived color (including color temperature) of the light exiting the lighting device is accurate (e.g., within a specific tolerance). A wide variety of such elements and combinations of elements are known, and any of them can be employed in the lighting devices according to the present inventive subject matter. For instance, representative examples of such elements and combinations of elements are described in:

U.S. patent application Ser. No. 11/755,149, filed May 30, 2007 (now U.S. Patent Publication No. 2007/0278974), the entirety of which is hereby incorporated by reference as if set forth in its entirety;

U.S. patent application Ser. No. 12/117,280, filed May 8, 2008 (now U.S. Patent Publication No. 2008/0309255), the entirety of which is hereby incorporated by reference as if set forth in its entirety;

U.S. patent application Ser. No. 12/257,804, filed on Oct. 24, 2008 (now U.S. Patent Publication No. 2009/0160363), the entirety of which is hereby incorporated by reference as if set forth in its entirety;

U.S. patent application Ser. No. 12/469,819, filed on May 21, 2009 (now U.S. Patent Publication No. 2010/0102199), the entirety of which is hereby incorporated by reference as if set forth in its entirety;

Embodiments in accordance with the present inventive subject matter are described herein in detail in order to provide exact features of representative embodiments that are within the overall scope of the present inventive subject matter. The present inventive subject matter should not be understood to be limited to such detail.

Embodiments in accordance with the present inventive subject matter are also described with reference to cross-sectional (and/or plan view) illustrations that are schematic illustrations of idealized embodiments of the present inventive subject matter. As such, variations from the shapes of the illustrations as a result, for example, of manufacturing techniques and/or tolerances, are to be expected. Thus, embodiments of the present inventive subject matter should not be construed as being limited to the particular shapes of regions illustrated herein but are to include deviations in shapes that result, for example, from manufacturing. For example, a molded region illustrated or described as a rectangle will, typically, have rounded or curved features. Thus, the regions illustrated in the figures are schematic in nature and their shapes are not intended to illustrate the precise shape of a region of a device and are not intended to limit the scope of the present inventive subject matter.

The lighting devices illustrated herein are illustrated with reference to cross-sectional drawings. These cross sections may be rotated around a central axis to provide lighting devices that are circular in nature. Alternatively, the cross sections may be replicated to form sides of a polygon, such as a square, rectangle, pentagon, hexagon or the like, to provide a lighting device. Thus, in some embodiments, objects in a center of the cross-section may be surrounded, either completely or partially, by objects at the edges of the cross-section.

Figure 2:
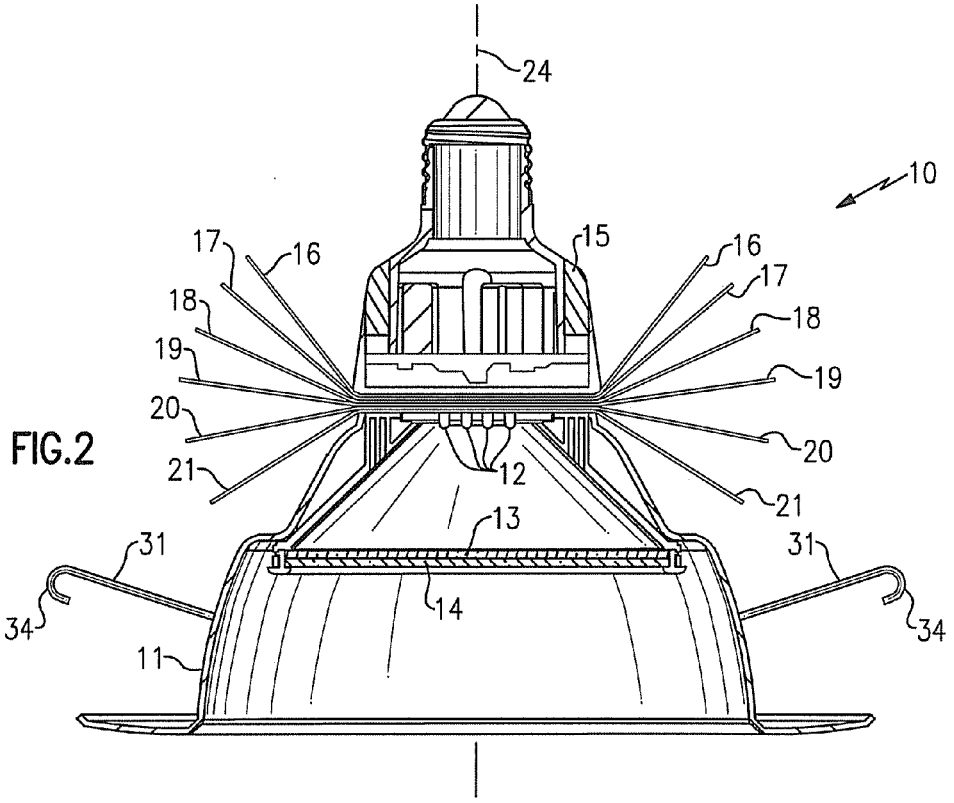
FIG. 2 is a sectional view of the lighting device 10.
Figure 3:
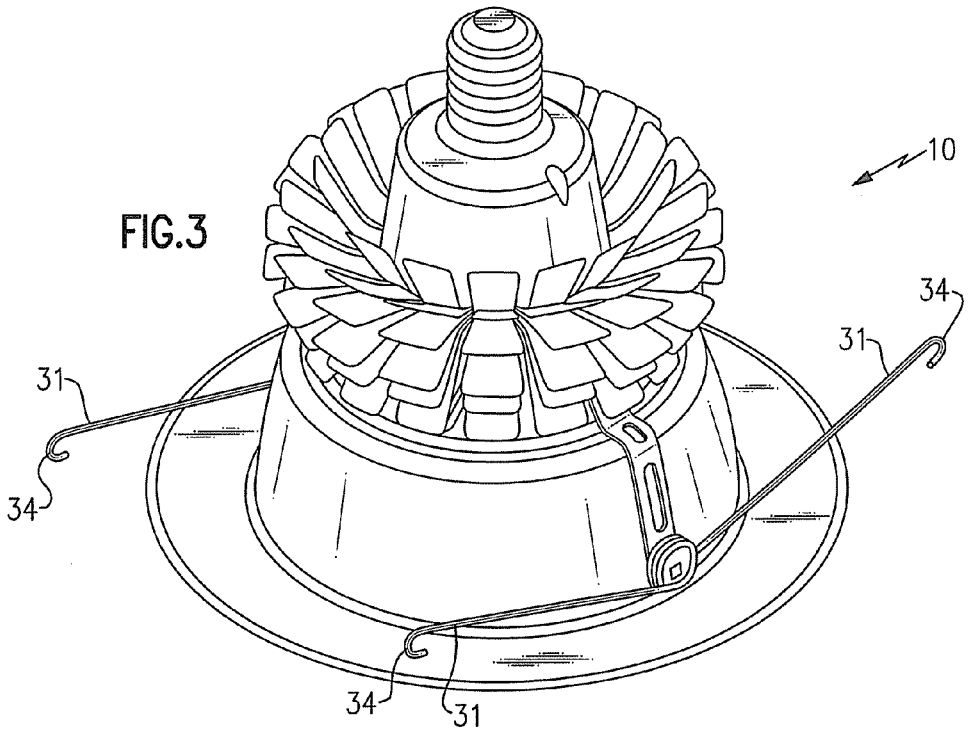
FIG. 3 is a perspective view of the lighting device 10.

FIGS. 1-3 illustrate a lighting device 10 in accordance with the present inventive subject matter. FIG. 1 is a schematic front elevation view of the lighting device 10, FIG. 2 is a sectional view (namely, a planar slice) of the lighting device 10, and FIG. 3 is a perspective view of the lighting device 10.

Referring to FIG. 2, the lighting device 10 comprises a trim element 11, a plurality of light sources 12, a diffuser film 13, a lens 14, a driver sub-assembly 15, a first heat sink element 16, a second heat sink element 17, a third heat sink element 18, a fourth heat sink element 19, a fifth heat sink element 20 and a sixth heat sink element 21.

The light sources 12 include a plurality of light emitting diodes that emit blue light, at least some of which are packaged with luminescent material that emits greenish-yellowish light and a plurality of light emitting diodes that emit red light.

Figure 4:
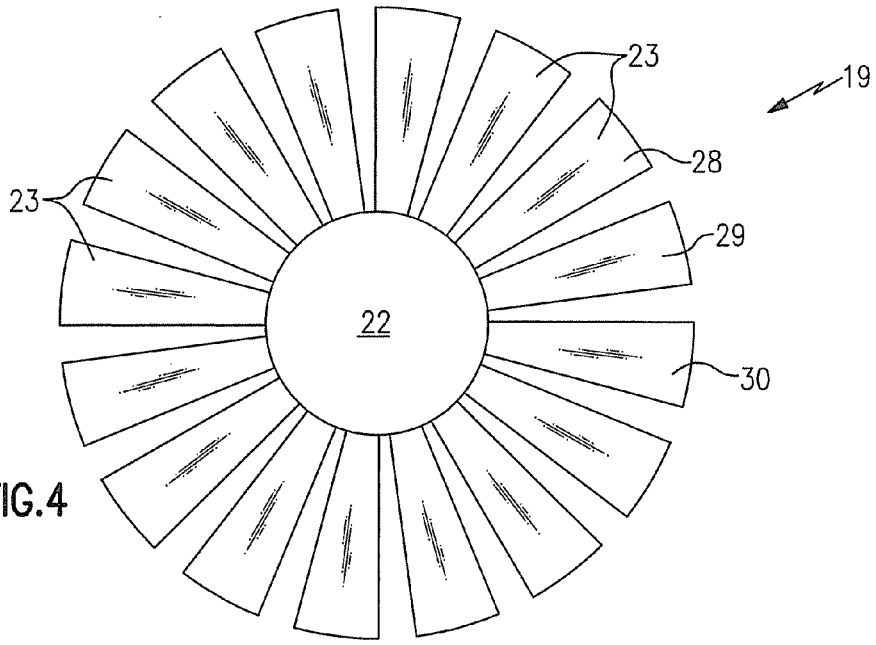
FIG. 4 is a top view of a heat sink element 19.

FIG. 4 is a top view of the fourth heat sink element 19. As shown in FIG. 4, the fourth heat sink element 19 comprises a first inner region 22 and a plurality of outer regions 23 (including, among others, a first outer region 28, a second outer region 29 and a third outer region 30), locations on the first inner region 22 being closer to the axis 24 of the trim element than locations on the outer regions 23.

Referring again to FIG. 2:

a bottom surface of the inner region of the first heat sink element 16 is in contact with a top surface of the inner region of the second heat sink element 17, a bottom surface of the inner region of the second heat sink element 17 is in contact with a top surface of the inner region of the third heat sink element 18, a bottom surface of the inner region of the third heat sink element 18 is in contact with a top surface of the inner region of the fourth heat sink element 19, a bottom surface of the inner region of the fourth heat sink element 19 is in contact with a top surface of the inner region of the fifth heat sink element 20, and a bottom surface of the inner region of the fifth heat sink element 20 is in contact with a top surface of the inner region of the sixth heat sink element 21.

Referring again to FIG. 2:

an angle of inclination of a first outer region 25 of the first heat sink element 16 relative to the axis 24 of the trim element 11, an angle of inclination of a first outer region 26 of the second heat sink element 17 relative to the axis 24 of the trim element 11, and an angle of inclination of a first outer region 27 of the third heat sink element 18 relative to the axis 24 of the trim element 11 each differ from each other by at least 15 degrees.

In addition:

the angle of inclination of the first outer region 28 of the fourth heat sink element 19 relative to the axis 24 of the trim element 11, an angle of inclination of the second outer region 29 of the fourth heat sink element 19 relative to the axis 24 of the trim element 11, and an angle of inclination of the third outer region 30 of the fourth heat sink element 19 relative to the axis 24 of the trim element 11 each differ from each other by not more than 5 degrees, a plane of substantial symmetry of the first outer region 28 of the fourth heat sink element 19 defines an angle of at least 15 degrees relative to a plane of substantial symmetry of the second outer region 29 of the fourth heat sink element 19, the plane of substantial symmetry of the first outer region 28 of the fourth heat sink element 19 defines an angle of at least 15 degrees relative to a plane of substantial symmetry of the third outer region 30 of the fourth heat sink element 19, and the plane of substantial symmetry of the second outer region 29 of the fourth heat sink element 19 defines an angle of at least 15 degrees relative to the plane of substantial symmetry of the third outer region 30 of the fourth heat sink element 19 (i.e., the "petals" of the fourth heat sink element 19 point in different directions, as do the "petals" of the other heat sink elements).

Although the heat sink elements 16-21 shown in FIGS. 1-3 each comprise outer regions as depicted in FIGS. 1-3, the outer regions can be of any suitable shape and/or some or all of the notches can be eliminated. For example, if all of the notches were eliminated from the heat sink elements 16-21 in FIGS. 1-3, the outer regions would be frustoconical (or annular if the angle of inclination were zero).

The embodiment depicted in FIGS. 1-3 includes two positioning-retaining elements, each of which is a spring-retaining clip that includes a pair of spring-loaded arms 31 (only one pair being visible in FIG. 1 (the other pair being mounted on the back side of the lighting device 10) that are receivable in corresponding engagement elements mounted on a fixture element.

Figure 5:
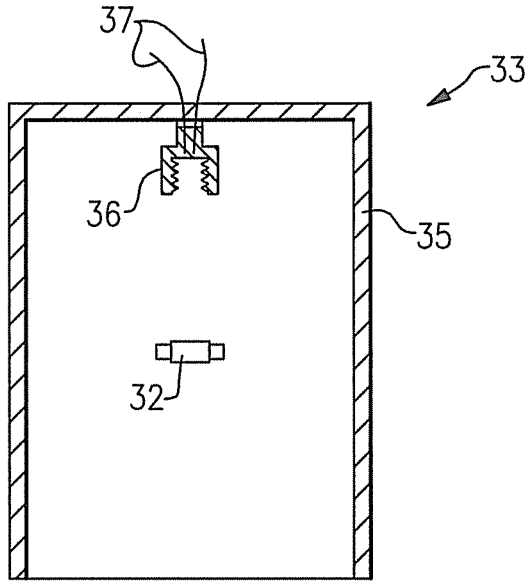
FIG. 5 is a schematic sectional view of a representative example of a fixture element 33 with which the lighting device 10 can be used.

FIG. 5 is a schematic sectional view of a representative example of a fixture element 33 with which the lighting device 10 can be used. Referring to FIG. 5, the fixture element 33 comprises a housing 35, a pair of generally C-shaped engagement elements 32 (only one being visible in FIG. 5), an Edison socket 36, and power lines 37.

The spring-loaded arms 31 are spring-biased apart from each other such that, if the lighting device 10 is attached to the fixture element 33 (or some other fixture element or housing or the like) the spring-loaded arms 31 are spring-biased into contact with opposite sides of the respective generally C-shaped engagement element 32. The spring-loaded arms 31 can be slid relative to the respective engagement element 32 while maintaining sufficient friction with the engagement element 32, so that the lighting device 10 is held in position relative to the fixture element 33 at virtually any location along the range over which the spring-loaded arms 31 can be slid relative to the engagement elements 32.

In the embodiment depicted in FIGS. 1-3, each of the spring-loaded arms 31 has a hook region 34 at a remote location, which can prevent the lighting device 10 from being moved relative to the fixture element 33 beyond a desired extreme location (e.g., it can prevent the lighting device 10 from dropping out of the fixture element 33).

As a representative explanation, each of the individual heat sink elements 16-21 can be conceptualized (and/or can be made in an analogous manner) by starting with a generally circular piece of material (i.e., a material that is suitable for use as a heat sink), creating notches that extend from various points on the perimeter about halfway toward the center of the circle (whereby the inner region of the heat sink element extends from the center of the circle about halfway out radially, i.e., to the innermost extent of the notches, and the outer regions extend from the perimeter of the inner region to the perimeter of the heat sink elements, each being separated from its neighbors by notches on either side), and then bending the outer regions, if necessary, to the desired angle of inclination. It is not necessary that the outer regions be planar or even substantially planar, and they can instead exhibit curled, wavy, or any other random or regular pattern of topography.

As a further representative explanation, two or more heat sink elements can be stacked, i.e., with the top surface of the inner region of each heat sink element (except for the heat sink element at the top of the stack) in contact with the bottom surface of the inner region of the heat sink element immediately above, and with the bottom surface of the inner region of each heat sink element (except for the heat sink element at the bottom of the stack) in contact with the top surface of the inner region of the heat sink element immediately below. In some embodiments, the angles of inclination of the outer regions of the heat sink elements increase with each heat sink element that is higher in the stack.

As a further representative explanation, a lighting device can be constructed by positioning a single heat sink element or a stack of heat sink elements between a driver sub-assembly and a trim element, and then the driver sub-assembly and the trim element are connected to each other (e.g., with screws or bolts that extend through at least a portion of the driver sub-assembly, optionally through holes in one or more heat sink elements, and through at least a portion of the trim element), whereby the heat sink element (or elements) is/are clamped between the driver sub-assembly and the trim element. Alternatively, the heat sink element (or elements) can be clamped between any other components (or regions of components) included in the lighting devices.

For instance, in the lighting device 10, the driver sub-assembly 15 and the trim element 11 are held together by screws that extend through a portion of the driver sub-assembly 15, through holes in the heat sink elements 16-21 and partway into the trim element 11. As a result, the heat sink elements 16-21 are clamped between the driver sub-assembly 15 and the trim element 11.

In some embodiments according to the present inventive subject matter, the number of heat sink elements can be selected, and/or the number of outer regions in the heat sink element or in any or all of the heat sink elements can be selected, so as to provide the necessary heat dissipation capability for each particular lighting device (i.e., based on the number and type of light source(s), the most challenging ambient conditions to which the lighting device will be expected to be subjected, the expected extent of air flow across the lighting device, the shape, thickness and material of all regions of the housing, etc.). In addition, in some embodiments according to the present inventive subject matter, the number of heat sink elements can be adjusted, and/or the number of outer regions in the heat sink element or in any or all of the heat sink elements can be adjusted, as needed or as desired, e.g., in order to correct an overheating tendency or condition, in order to compensate for changes in ambient temperatures, in order to make the lighting device suitable for a different deployment, in order to run the light source(s) cooler, etc.

Figure 6:
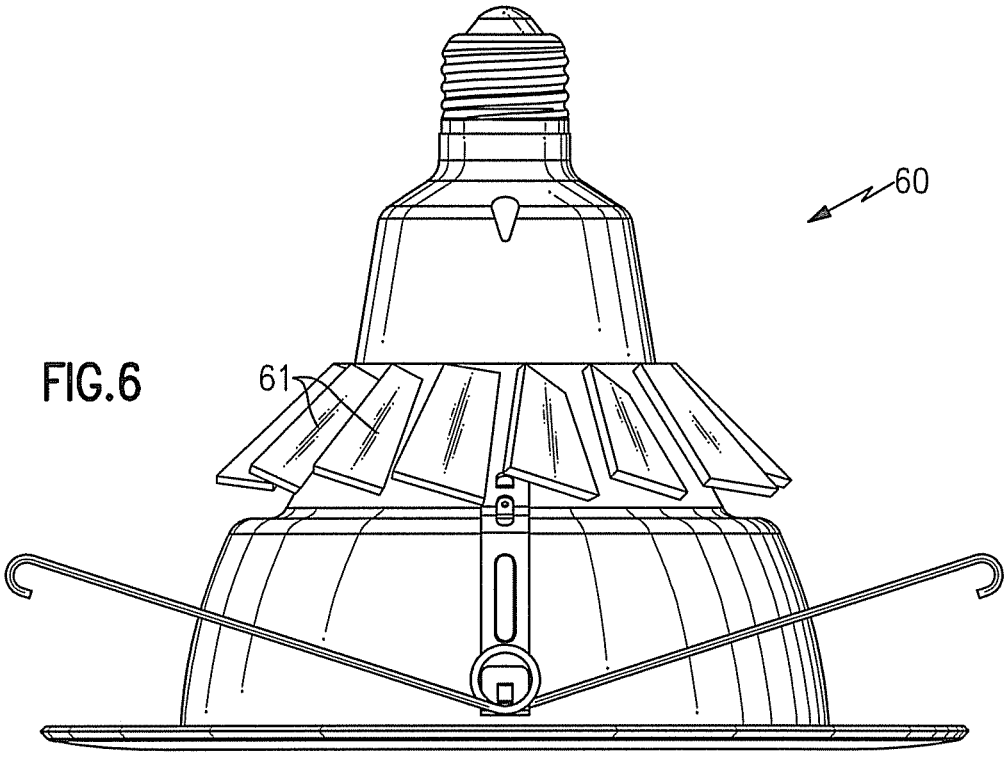
FIG. 6 is a front view of a lighting device 60 in accordance with the present inventive subject matter.

FIG. 6 is a front view of a lighting device 60 in accordance with the present inventive subject matter. The lighting device 60 is similar to the lighting device 10, except that the lighting device 60 has only a single heat sink element 61.

Figure 7:
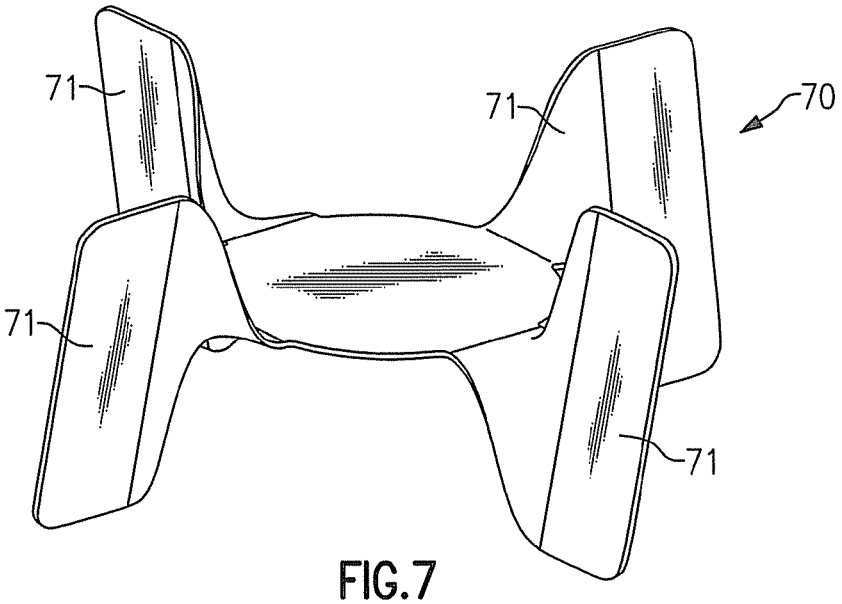
FIG. 7 is a perspective view of a heat sink element 70.

FIG. 7 is a perspective view of a heat sink element 70 that is shaped differently from the heat sink elements 16-21 depicted in the lighting device 10 shown in FIGS. 1-2. Referring to FIG. 7, the heat sink element 70 comprises four outer regions 71, each in the shape of a fin.

As a representative example, the heat sink element 70 could be made by blanking the fin shape, and then forming the fins into the final twisted fin shape using a die. A favorable property of fins as depicted in FIG. 7 is that the fins can be made vertical (i.e., having a major dimension parallel to the axis of the trim element) or near vertical (or vertical to any desired degree), so that the fins do not interfere with each other thermally (or so that thermal interference is reduced or minimized). A plurality of heat sink elements 70 can be stacked, if desired, with the respective heat sink elements 70 rotated different amounts so that the fins of respective heat sink elements do not come into contact and/or are spaced substantially as far as possible from each other. While FIG. 7 depicts a heat sink element 70 having four fins, the number of fins can be selected to be greater or less as desired, e.g., to be any suitable number.

Figure 8:
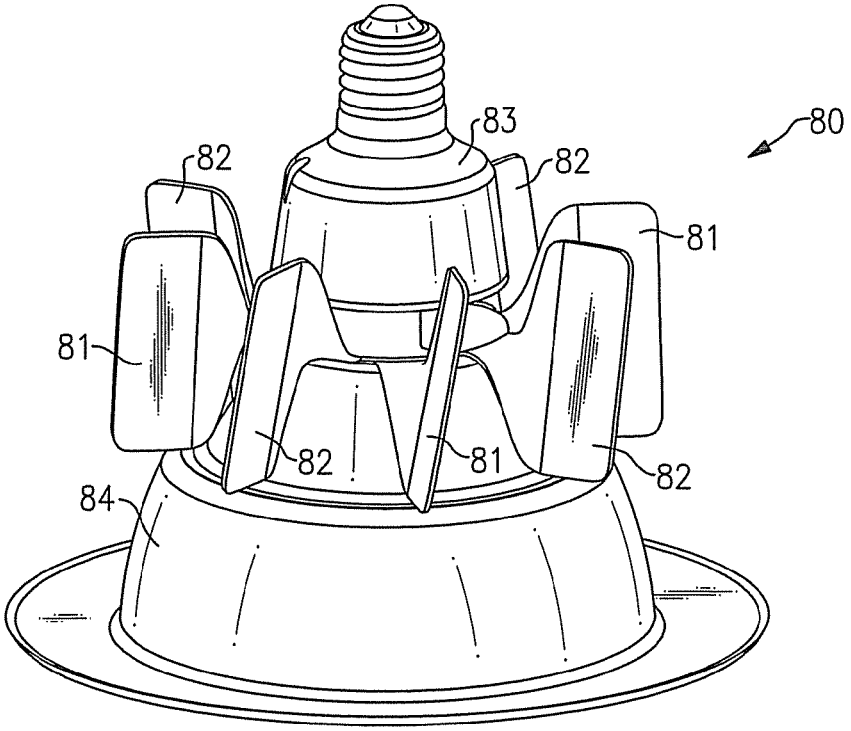
FIG. 8 is a perspective view of a lighting device 80 that comprises two stacked heat sink elements.

FIG. 8 is a perspective view of a lighting device 80 that comprises two stacked heat sink elements 81 and 82 (each of which is similar in shape to the heat sink element 71). The lighting device 80 further comprises a driver sub-assembly 83 and a trim element 84, between which the heat sink elements 81 and 82 are clamped.

Figure 9:
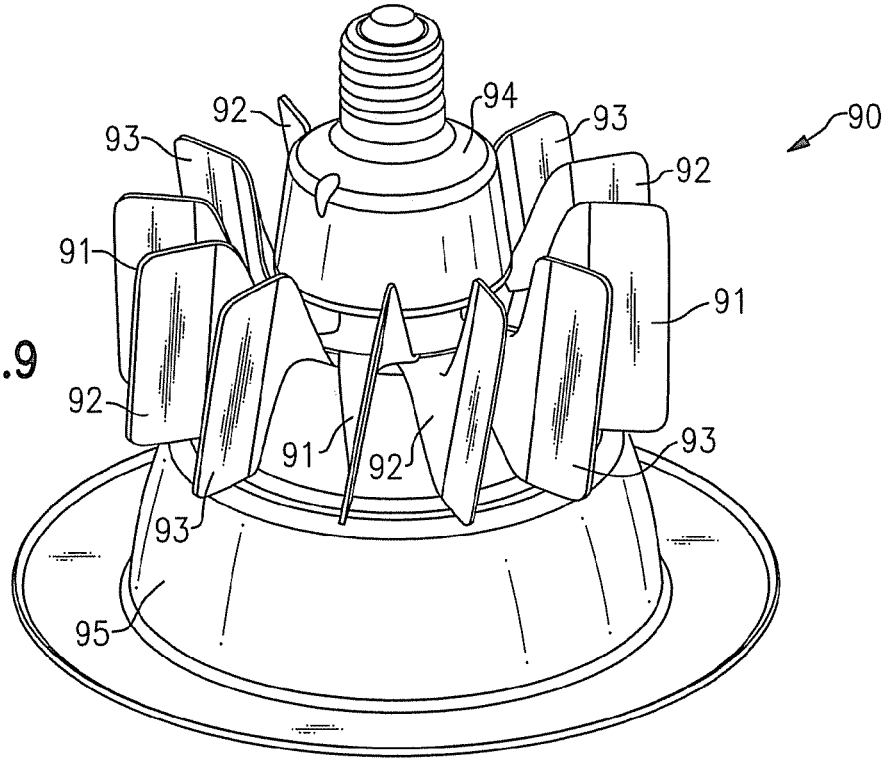
FIG. 9 is a perspective view of a lighting device 90 that comprises three stacked heat sink elements.

FIG. 9 is a perspective view of a lighting device 90 that comprises three stacked heat sink elements 91, 92 and 93 (each of which is similar in shape to the heat sink element 71). The lighting device 90 further comprises a driver sub-assembly 94 and a trim element 95, between which the heat sink elements 91, 92 and 93 are clamped.

Figure 10:
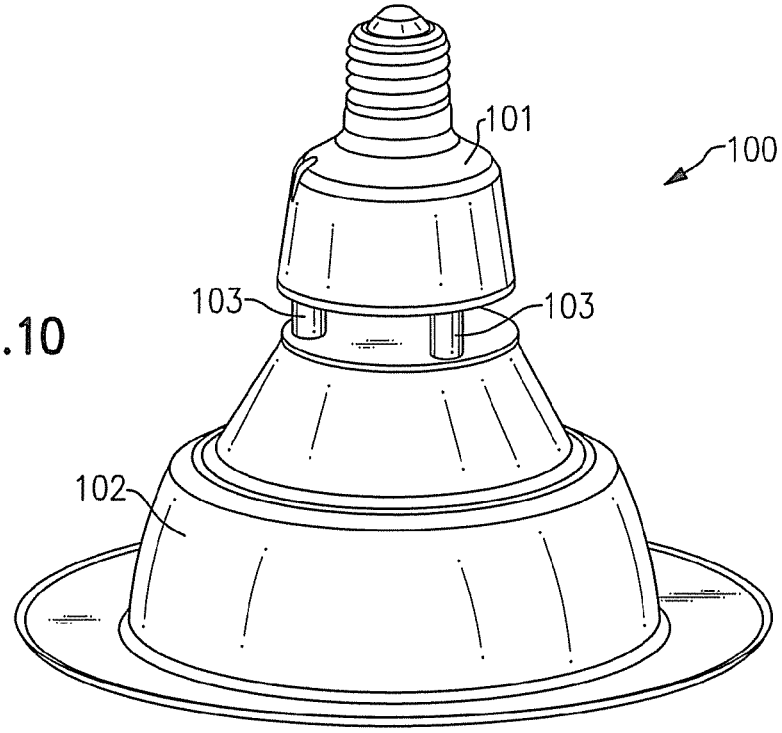
FIG. 10 is a perspective view of a lighting device 100.

FIG. 10 is a perspective view of a lighting device 100 that comprises a driver sub-assembly 101, a trim element 102 and three spacer elements 103 (only two of the three spacer elements 103 are visible in FIG. 10). The spacer elements 103 provide a space between the driver sub-assembly 101 and the trim element 102. By providing the spacer elements 103, what is frequently the hottest part of the lighting device, namely, the region of the trim element 102 on which the light sources, e.g., light emitting diodes, can be mounted, is exposed to open air, facilitating heat dissipation from a larger surface area of the top of the trim element 102 (as well as facilitating heat dissipation from a larger surface area of the bottom of the driver sub-assembly 101).

Figure 11:
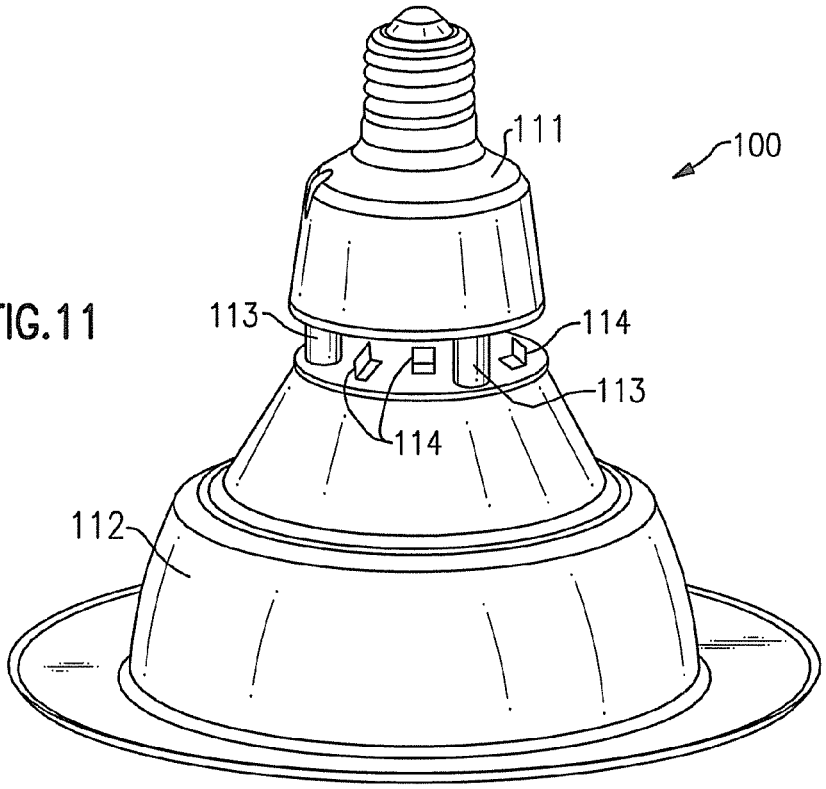
FIG. 11 is a perspective view of a lighting device 110.

FIG. 11 is a perspective view of a lighting device 110 that comprises a driver sub-assembly 111, a trim element 112 and three spacer elements 113 (only two of the three spacer elements 113 are visible in FIG. 11), similar to the analogous elements depicted in the lighting device 100 shown in FIG. 10. The lighting device 110 further comprises a plurality of heat sink structures 114 that are attached (removably or non-removably) to the upper surface of the trim element 112. Any desired number of heat sink structures 114 can be employed. Although the heat sink structures 114 are depicted in FIG. 11 as being L-shaped, they can be of any suitable shape (and they can be of any suitable size)(and different heat sink structures 114 can be of shape and/or size that differ from the shape and/or size of one or more other heat sink structures 114), and they can fit completely within the space between the driver sub-assembly 111 and the trim element 112, or can protrude at least partially from the space (or be positioned outside the space). In addition, although the heat sink structures 114 are depicted in FIG. 11 as being attached to the top of the trim element 112, some or all of the heat sink structures 114 can instead be attached to the bottom of the driver sub-assembly 111.

Figure 12:
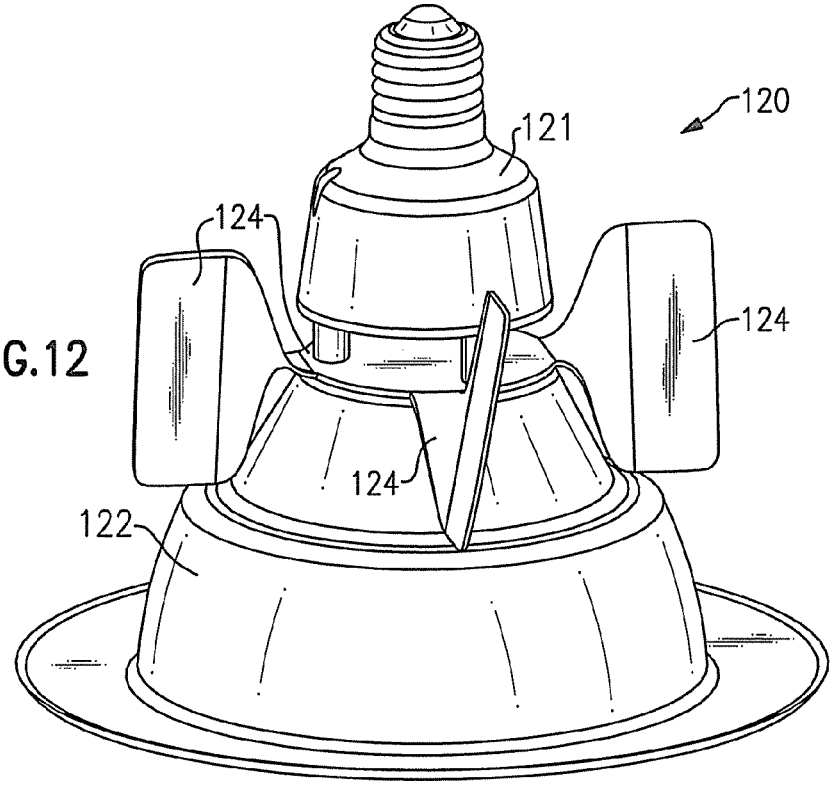
FIG. 12 is a perspective view of a lighting device 120.

FIG. 12 is a perspective view of a lighting device 120 that is similar to the lighting device 100 depicted in FIG. 10, except that the lighting device 120 depicted in FIG. 12 further comprises a heat sink element 124 (that is similar to the heat sink element 70 depicted in FIG. 7) positioned between the driver sub-assembly 121 and the trim element 122. Additional heat sink elements can be added, if desired, and/or the number of fins on the heat sink element or on one or more of the heat sink elements can be other than four.

Figure 13:
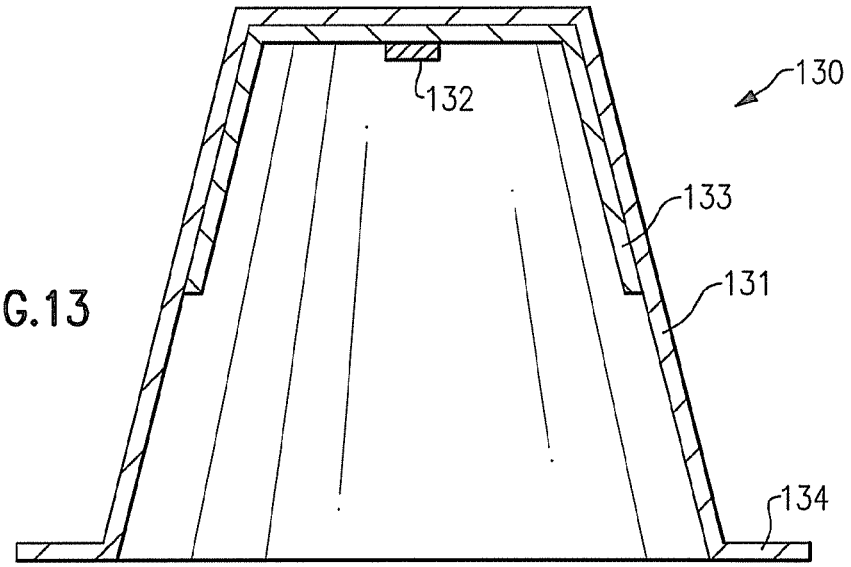
FIG. 13 is a schematic sectional view of a lighting device 130.

FIG. 13 is a schematic sectional view of a lighting device 130 that comprises a trim element 131 that has a rim 134 on a remote end and a light source 132. In lighting devices like this one, primary heat flow is frequently from the light source 132 (e.g., one or more light emitting diodes) through the thickness of the trim element 131 to the rim 134 (which may extend into the room, i.e., the lighting device 130 can be mounted such that the upper surface of the rim 134 is in contact with the ceiling in which the lighting device 130 is mounted; this path may have the greatest temperature gradient and the lowest thermal resistance, especially since the cross-sectional area of the trim element increases (and thermal resistance therefore usually decreases accordingly) with increasing diameter. In order to provide an extra path for getting heat from locations on the trim element 131 that are near the light source 132 to locations on the trim element 131 that have lower thermal resistance, a removable heat sink element 133 as shown in FIG. 13 is provided, in which the heat sink element 133 can be of substantially uniform thickness, is positioned inside the trim element 131, and follows the contour of the inner surface of the upper portion of the trim element 131. The heat sink element 133 and the trim element 131 can be pressed together, perhaps with glue and/or adhesive positioned between them. In addition, if desired, one or more materials that enhance heat transfer (such as a thermal pad, thermal grease, graphite sheets, etc.) can be positioned between the heat sink element 133 and the trim element 131. The heat sink element 133 can be held in place, for example, by being clamped between respective portions of the lighting device (e.g., between the top of the trim element 131 and a driver sub-assembly). As seen in FIG. 13, the heat sink element 133 includes a first portion (horizontal in FIG. 13) that is positioned between the light source 132 and a first portion of the trim element 131, as well as a sloped (frustoconical) portion that extends downward and away from the axis of the trim element 131, i.e., the heat sink element 133 includes locations that are included in respective planes that are perpendicular to the axis of the trim element and that are spaced from each other.

Figure 14:
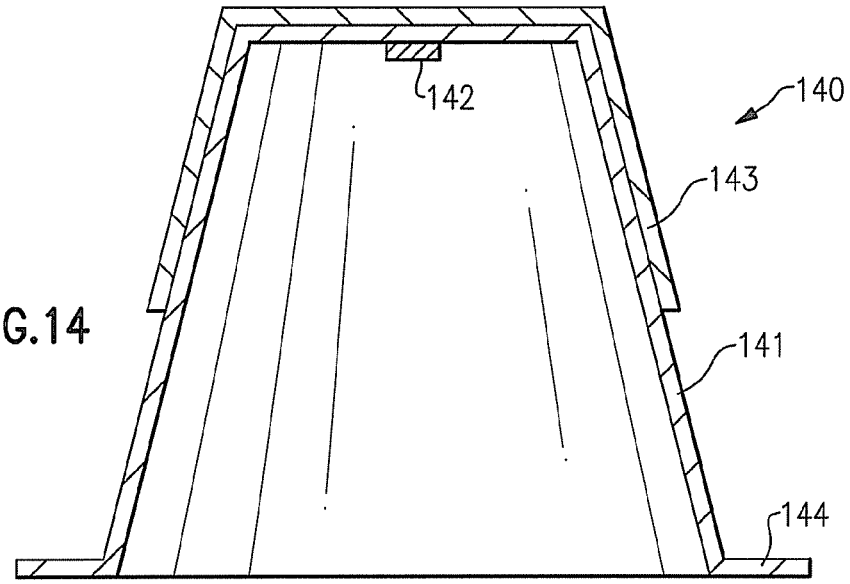
FIG. 14 is a schematic sectional view of a lighting device 140.

FIG. 14 is a schematic sectional view of a lighting device 140 that comprises a trim element 141 that has a rim 144 on a remote end, a light source 142 and a heat sink element 143. The lighting device 140 is similar to the lighting device 130, except that in the lighting device depicted in FIG. 14, the heat sink element 143 is positioned outside the trim element 141 and follows the contour of the outer surface of the upper portion of the trim element 141.

The present inventive subject matter further provides lighting devices that comprise any combination of one or more of each of the heat sink elements, spacer elements and heat sink structures described above.

The present inventive subject matter provides lighting devices in which the heat sink element (or elements) and/or the heat sink structure (or structures), or any of the heat sink element (or elements) and/or the heat sink structure (or structures) is/are removable, and/or in which any (or all) of them is/are not removable.

For example, in some embodiments according to the present inventive subject matter, the type (or types) of heat sink element, heat sink structure(s) and/or spacer element(s) employed in the lighting device, the number and size of any such heat sink element(s), heat sink structure(s) and/or spacer element(s), and/or the number of outer regions in the heat sink element or in any or all of the heat sink elements can be selected, so as to provide the necessary heat dissipation capability for each particular lighting device (i.e., based on the number and type of light source(s), the most challenging ambient conditions to which the lighting device will be expected to be subjected, the expected extent of air flow across the lighting device, the shape, thickness and material of all regions of the housing, etc.). In addition, in some embodiments according to the present inventive subject matter, the number of heat sink elements and/or heat sink structures can be adjusted, and/or the number of outer regions in one or more respective heat sink elements can be adjusted, as needed or as desired, e.g., in order to correct an overheating tendency or condition, in order to compensate for changes in ambient temperatures, in order to make the lighting device suitable for a different deployment, in order to run the light source(s) cooler, etc.

FIGS. 15-22 schematically depict a lighting device 200 in accordance with the present inventive subject matter.

Figure 15:
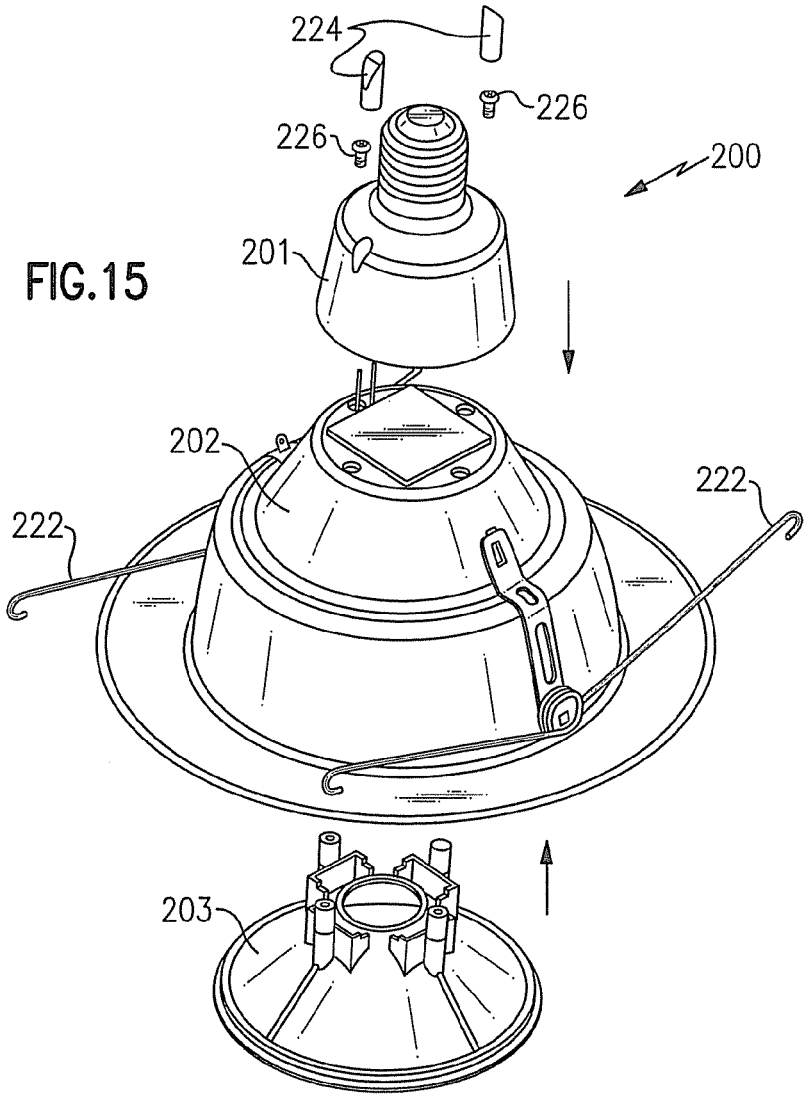
Figure 16:
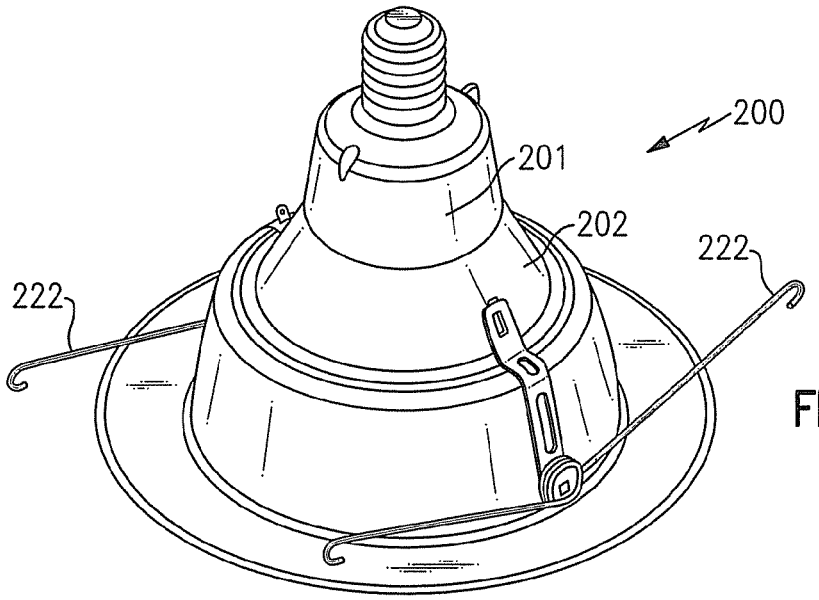

FIG. 15 is an exploded perspective view of the lighting device 200, and FIG. 16 is a perspective view of the lighting device 200.

The lighting device 200 (see FIG. 15) comprises a driver sub-assembly 201, a trim sub-assembly 202 and a mixing chamber sub-assembly 203.

The lighting device 200 can have one or more heat sink elements (which can individually have any suitable outer region or regions), one or more heat sink structures and/or one or more spacer elements (each of any suitable shape and size), which can be as described above or not, positioned between the driver sub-assembly 201 and the trim sub-assembly 202, or at any other suitable location.

Figure 17:
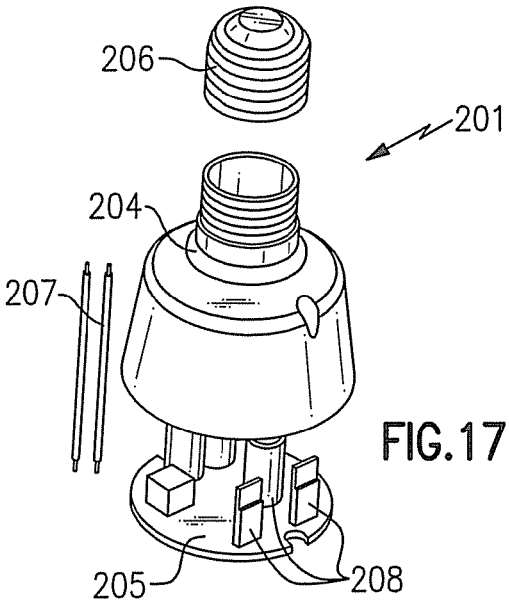
Figure 18:
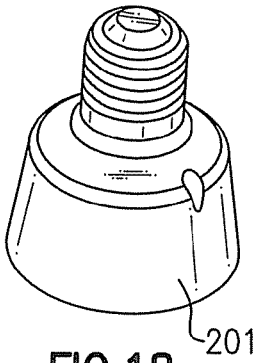

FIG. 17 is an exploded perspective view of the driver sub-assembly 201, and FIG. 18 is a perspective view of the driver sub-assembly 201.

Figure 19:
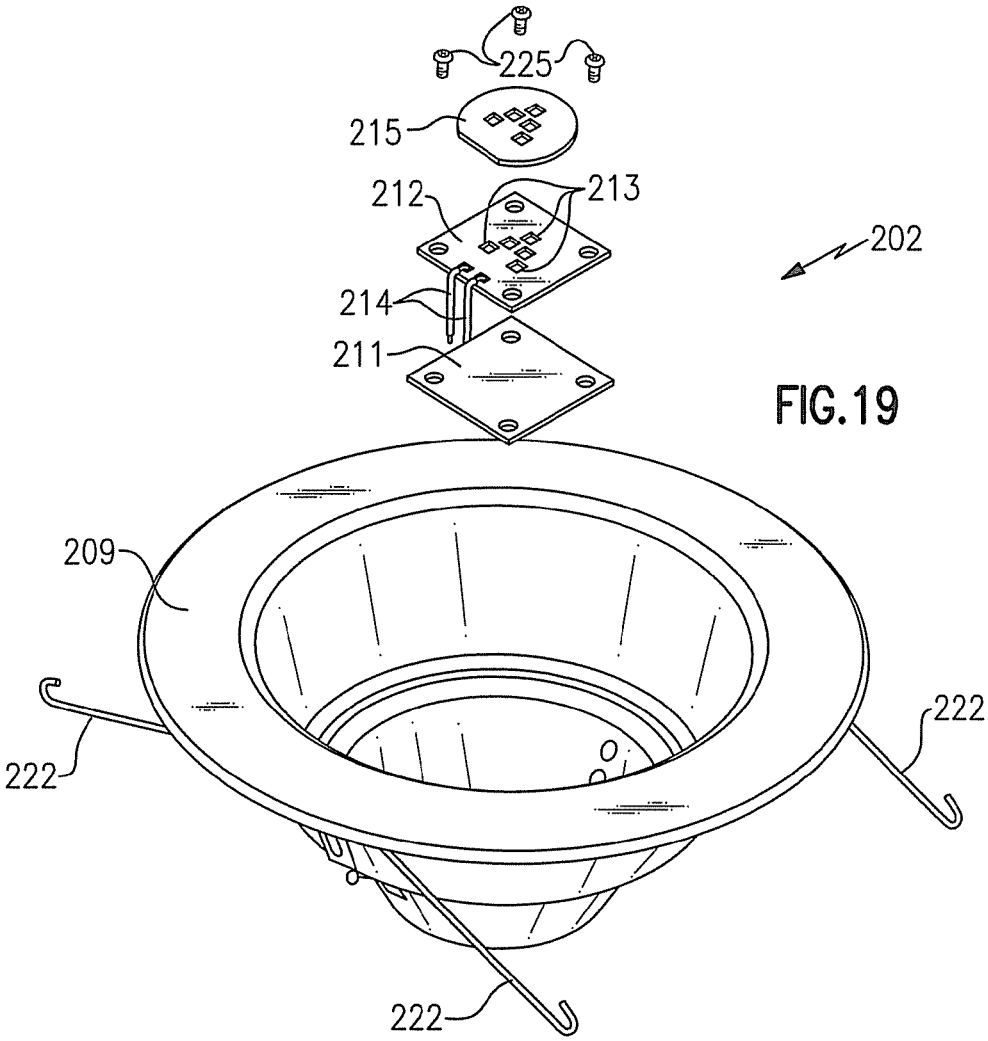

FIG. 19 is an exploded perspective view of the trim sub-assembly 202, and FIG. 20 is a perspective view of the trim sub-assembly 202.

FIG. 21 is an exploded perspective view of the mixing chamber sub-assembly 203, and FIG. 22 is a perspective view of the mixing chamber sub-assembly 203.

The driver sub-assembly 201 (see FIG. 17) comprises a housing 204, a driver circuit board 205, an Edison screw 206 and input wires 207. A plurality of circuitry components 208 are mounted on the driver circuit board 205. In this embodiment, the housing 204 is made of plastic, but alternatively it can be made of any other suitable material or materials.

The trim sub-assembly 202 (see FIG. 19) comprises a trim element 209, electrical insulation 210 (or a Formex sheet or any other suitable electrically insulating element), a thermally conductive pad 211, a light emitting diode circuit board 212 (e.g., a metal core circuit board), a plurality of light emitting diodes 213 (mounted on the light emitting diode circuit board 212), light emitting diode board wires 214 and a reflector sheet 215. The electrical insulation 210 can be any suitable material for providing ample electrical insulation between the driver circuit board 205 and the light emitting diode circuit board 212, e.g., insulation tape, Formex sheet, etc.

The mixing chamber sub-assembly 203 (see FIG. 21) comprises a mixing chamber element 216, a mixing chamber reflector 217, a diffuser film 218, a lens 219 and a lens retainer 220. In this embodiment, the mixing chamber element 216 is made of plastic, but alternatively it can be made of any other suitable material or materials. In this embodiment, the lens 219 is made of glass, but alternatively it can be made of any other suitable material or materials. The lens retainer 220 can be of any suitable design, e.g., as described in:

U.S. Patent Application No. 60/861,901, filed on Nov. 30, 2006, entitled "LED DOWNLIGHT WITH ACCESSORY ATTACHMENT" (inventors: Gary David Trott, Paul Kenneth Pickard and Ed Adams; the entirety of which is hereby incorporated by reference as if set forth in its entirety; and U.S. patent application Ser. No. 11/948,041, filed Nov. 30, 2007 (now U.S. Patent Publication No. 2008/0137347), the entirety of which is hereby incorporated by reference as if set forth in its entirety.

The driver sub-assembly 201 can be assembled by soldering one end of each of the input wires 207 to the driver circuit board 205, inserting the driver circuit board 205 into the housing 204, soldering the other end of each of the input wires 207 to the Edison screw 206, and gluing the Edison screw 206 to the housing 204.

The trim sub-assembly 202 can be assembled by applying the insulation 210 to the trim element 209 (alternatively, the insulation 210 can simply rest between the trim sub-assembly 202 and the driver sub-assembly 201). Trim sub-assembly nuts (into which trim sub-assembly bolts will be received, as described later) can be positioned in an assembly jig, then the trim element 209 can be placed in the assembly jig, then the light emitting diode board wires 214 can be soldered to the light emitting diode circuit board 212. The wires between the driver and the light emitting diode circuit board 112 can previously have been connected to the driver circuit board 105 (i.e., prior to assembly of the driver sub-assembly). The end of the wire that is connected to the light emitting diode circuit board 112 may include a connector to allow for easy connection to the light emitting diode circuit board 112, or it can be soldered to save cost. Alternatively, the wires may be soldered to the light emitting diode circuit board 112 and may have a connecter at the end that connects to the driver circuit board 105 (and/or to a driver end of a power supply unit), in which case the cable and the connector could plug into a mating socket on the underside of the driver circuit board 105. Then, the thermal pad 211 and the light emitting diode circuit board 212 can be placed in the trim element 209, then trim sub-assembly bolts 225 can be inserted through holes in the light emitting diode circuit board 212 and through corresponding holes in the thermal pad 211 and into the trim sub-assembly nuts, and the bolts 225 can be tightened, and then the reflector sheet 215 can be applied onto the light emitting diode circuit board 212 (with the illumination surfaces of the light emitting diodes 213 aligned with corresponding openings in the reflector sheet 215). Instead of the trim sub-assembly bolts and trim sub-assembly nuts, any other connecting elements can be employed, e.g., spring clips, screws, rivets, adhesive, etc.

The mixing chamber sub-assembly 203 can be assembled by placing the mixing chamber reflector 217 on the mixing chamber element 216, placing the diffuser film 218 and the lens 219 in the mixing chamber element 216, and snap-fitting the lens retainer 220 on the mixing chamber element 216. In some embodiments, the mixing chamber reflector 117 may be attached to the mixing chamber element 116, for example, by press fitting or by an adhesive to secure the mixing chamber reflector 117 to the mixing chamber element 116.

The lighting device 200 can be assembled by placing the mixing chamber sub-assembly 203 in an assembly jig, placing the trim sub-assembly 202 in the assembly jig, soldering the light emitting diode board wires 214 to the driver circuit board 205, placing any heat sink elements and/or spacer elements on or in the trim sub-assembly 202 (and/or attaching spacer elements to the driver sub-assembly 201), placing the driver sub-assembly 201 in the assembly jig, inserting screws 226 through openings provided in the driver sub-assembly 201, through corresponding openings provided in the trim sub-assembly 202 and into corresponding holes provided in the mixing chamber sub-assembly 203 and tightening the screws 226 down. If desired, heat sink structures can be attached to the upper surface of the trim sub-assembly 202 and/or to the lower surface of the driver sub-assembly 201. If desired, screw hole covers 224 can be inserted into the openings in the driver sub-assembly 201 to cover the screws and provide a smooth surface on the driver sub-assembly 201. Instead of the screws, any other connecting elements can be employed, e.g., nut and bolt combinations, spring clips, rivets, adhesive, etc.

The lighting device 200 depicted in FIGS. 15-22 can also include spring retainer clips which each include first and second spring-loaded arms 222 that are engageable in a corresponding engagement element mounted on a fixture in which the lighting device 200 is positioned. Each pair of first and second spring loaded arms 222 can be spring biased apart from each other into contact with opposite sides of the corresponding engagement element, creating friction which holds the lighting device 200 in position relative to the fixture, while permitting the lighting device 200 to be moved to different positions relative to the fixture (alternatively, the first and second spring loaded arms 222 can be spring biased toward each other into contact with opposite sides of a corresponding engagement element, thereby similarly creating friction which holds the lighting device 200 in position relative to the fixture, while permitting the lighting device 200 to be moved to different positions relative to the fixture). Instead of the spring retainer clips, the lighting device can include any other suitable structure for adjustably holding the lighting device 200 in place relative to a fixture.

Although a description of the assembly of the driver sub-assembly 201, the trim sub-assembly 202, the mixing chamber sub-assembly 203 and the lighting device 200 is set forth above, the lighting device 200 and the components thereof can be assembled in any other suitable way.

While not illustrated in the Figures for some of the lighting devices described above, thermal grease, thermal pads, graphite sheets or other materials known to those of skill in the art for increasing thermal coupling between any components (e.g., between respective heat sink elements) can be employed.

In any lighting device in accordance with the present inventive subject matter that comprises one or more solid state light emitters (e.g., one or more light emitting diodes), the solid state light emitter, or one or more of the solid state light emitters, can be mounted directly on the trim element (and/or, when a mixing chamber element is included, directly on the mixing chamber element). In such devices, power can be delivered to the solid state light emitter or solid state light emitters that is/are mounted directly on the trim element (and/or on a mixing chamber element) in any suitable way, e.g., through conductive traces provided on the trim element (and/or on a mixing chamber element), through wires connected to one or more circuit boards, through traces embedded in the trim element (and/or a mixing chamber element), through contacts that extend through the trim element (and/or a mixing chamber element), etc.

Mounting solid state light emitters directly on the trim element (and/or on a mixing chamber element) can reduce or minimize the thermal interfaces between the solid state light emitters and the ambient environment where the trim element (and/or a mixing chamber element) acts as a heat sink for the solid state light emitters and is exposed to a room. Mounting solid state light emitters directly on the trim element (and/or on a mixing chamber element) can also eliminate the cost of a metal core circuit board. In other devices, one or more solid state light emitters could be mounted on a circuit board (e.g., a metal core circuit board) that is mounted on the trim element (and/or a mixing chamber element).

In some lighting devices in which the solid state light emitter or one or more of the solid state light emitters is/are mounted directly on the trim element, one or more thermal element can be provided that is on the trim element in a location where it can serve a specific solid state light emitter or group of solid state light emitters. A representative example of a suitable thermal element is a projection that extends from the side of the trim element that is opposite the side on which the solid state light emitter(s) is/are mounted. Alternatively or additionally a portion of the heat sink adjacent to the solid state light emitter (or solid state light emitters) can be removed (and optionally filled with a thermal element or a part of a thermal element). A thermal element can be made of any suitable material, and can be of any suitable shape. Use of materials having higher heat conductivity in making the thermal element(s) generally provides greater heat transfer, and use of thermal element(s) of larger surface area and/or cross-sectional area generally provides greater heat transfer. Representative examples of materials that can be used to make the thermal element(s), if provided, include metals, diamond, DLC, etc.

In some embodiments according to the present inventive subject matter, the lighting device can comprise a mixing chamber element (i.e., an element that defines a region in which light emitted by the one or more light sources can mix), or the trim element can comprise a mixing chamber element (e.g., the mixing chamber element can be integral with the trim element, and/or the trim element can comprise a region that functions as a mixing chamber).

In some embodiments according to the present inventive subject matter, a single structure can be provided which acts as the trim element and as a mixing chamber element. In some embodiments, such structure can also comprise some or all of the thermal management system for the lighting device. By providing such a structure, it is possible to reduce or minimize the thermal interfaces between the light source(s) and the ambient environment (and thereby improve heat transfer), especially, in some cases, in devices in which the trim element acts as a heat sink for light source(s) (e.g., solid state light emitters) and is exposed to a room. In addition, such a structure can eliminate one or more assembly steps, and/or reduce parts count. In such lighting devices, the structure (i.e., the combined trim element and mixing chamber element) can further comprise one or more reflector and/or reflective film, with the structural aspects of the mixing chamber being provided by the trim element (i.e., by the combined trim element and mixing chamber).

While certain embodiments of the present inventive subject matter have been illustrated with reference to specific combinations of elements, various other combinations may also be provided without departing from the teachings of the present inventive subject matter. Thus, the present inventive subject matter should not be construed as being limited to the particular exemplary embodiments described herein and illustrated in the Figures, but may also encompass combinations of elements of the various illustrated embodiments.

Many alterations and modifications may be made by those having ordinary skill in the art, given the benefit of the present disclosure, without departing from the spirit and scope of the inventive subject matter. Therefore, it must be understood that the illustrated embodiments have been set forth only for the purposes of example, and that it should not be taken as limiting the inventive subject matter as defined by the following claims. The following claims are, therefore, to be read to include not only the combination of elements which are literally set forth but all equivalent elements for performing substantially the same function in substantially the same way to obtain substantially the same result. The claims are thus to be understood to include what is specifically illustrated and described above, what is conceptually equivalent, and also what incorporates the essential idea of the inventive subject matter.

Any two or more structural parts of the lighting devices described herein can be integrated. Any structural part of the lighting devices described herein can be provided in two or more parts (which may be held together in any known way, e.g., with adhesive, screws, bolts, rivets, staples, etc.).

The invention claimed is:

1. A lighting device comprising:

at least a first light source; and at least a first removable heat sink element and a second removable heat sink element, a contact portion of the first removable heat sink element in direct physical contact with a contact portion of the second removable heat sink element, the first and second removable heat sink elements individually removable from each other and from the lighting device.

2. A lighting device as recited in claim 1, wherein the lighting device further comprises a trim element.

3. A lighting device as recited in claim 2, wherein:

the lighting device further comprises a driver sub-assembly, and at least the first removable heat sink element is between a portion of the driver sub-assembly and a portion of the trim element.

4. A lighting device as recited in claim 2, wherein:

the lighting device further comprises a driver sub-assembly, the lighting device comprises at least two heat sink elements, including at least the first removable heat sink element and a second removable heat sink element, and at least the first removable heat sink element and the second removable heat sink element are between a portion of the driver sub-assembly and a portion of the trim element.

5. A lighting device as recited in claim 4, wherein a shape of the first removable heat sink element and a shape of the second removable heat sink element are substantially identical, with the second removable heat sink element rotated about the axis of the trim element at least five degrees relative to the first removable heat sink element.

6. A lighting device as recited in claim 2, wherein at least a first portion of the first removable heat sink element is in thermal contact with at least a first portion of a first surface of the trim element.

7. A lighting device as recited in claim 6, wherein the first portion of the first removable heat sink element is between the first light source and the first portion of the trim element.

8. A lighting device as recited in claim 6, wherein the first portion of the first surface of the trim element is between the first light source and the first portion of the first removable heat sink element.

9. A lighting device as recited in claim 6, wherein the first portion of the first removable heat sink element includes locations that are included in respective planes that are perpendicular to the axis of the trim element and that are spaced from each other.

10. A lighting device as recited in claim 2, wherein the first heat sink element comprises at least a first inner region and at least a first outer region, the first inner region of the first heat sink element closer to an axis of the trim element than the first outer region of the first heat sink element.

11. A lighting device as recited in claim 10, wherein:

the lighting device comprises at least the first removable heat sink element and a second removable heat sink element, the first heat sink element comprises a plurality of outer regions, each of the outer regions of the first heat sink element farther from the axis of the trim element than the first inner region of the first heat sink element, the second heat sink element comprises at least a first inner region and a plurality of outer regions, each of the outer regions of the second heat sink element farther from the axis of the trim element than the first inner region of the second heat sink element, a contact portion of the first inner region of the first heat sink element is in contact with a contact portion of the first inner region of the second heat sink element.

12. A lighting device as recited in claim 11, wherein angles of inclination of each of at least three outer regions of the second heat sink element differ by at least about 15 degrees from each angle of inclination of at least three outer regions of the first heat sink element.

13. A lighting device as recited in claim 10, wherein an axis of substantial symmetry of the first outer region of the first heat sink element passes within a distance from the axis of the trim element which is not greater than one-third of a dimension of the first outer region of the first heat sink element in a direction along the axis of substantial symmetry of the first outer region of the first removable heat sink element.

14. A lighting device as recited in claim 10, wherein:

the lighting device comprises at least three heat sink elements including the first removable heat sink element, a second removable heat sink element and a third removable heat sink element, the first outer region of the first heat sink element has a first angle of inclination relative to the axis of the trim element, a first outer region of the second heat sink element has a second angle of inclination relative to the axis of the trim element, a first outer region of the third heat sink element has a third angle of inclination relative to the axis of the trim element, the first angle of inclination differs from the second angle of inclination by at least about 15 degrees, the first angle of inclination differs from the third angle of inclination by at least about 15 degrees, and the second angle of inclination differs from the third angle of inclination by at least about 15 degrees.

15. A lighting device as recited in claim 14, wherein:

the first heat sink element has at least three outer regions, including the first outer region of the first heat sink element, a second outer region of the first heat sink element and a third outer region of the first heat sink element, the first outer region of the first heat sink element has a first angle of inclination relative to the axis of the trim element, the second outer region of the first heat sink element has a second angle of inclination relative to the axis of the trim element, the third outer region of the first heat sink element has a third angle of inclination relative to the axis of the trim element, the first angle of inclination is equal to or differs from the second angle of inclination by not more than about 5 degrees, the first angle of inclination is equal to or differs from the third angle of inclination by not more than about 5 degrees, the second angle of inclination is equal to or differs from the third angle of inclination by not more than about 5 degrees, a first plane of substantial symmetry of the first outer region of the first heat sink element, which first plane encompasses the axis of the trim element, defines an angle of at least 15 degrees relative to a second plane of substantial symmetry of the second outer region of the first heat sink element, which second plane encompasses the axis of the trim element, the first plane of substantial symmetry defines an angle of at least 15 degrees relative to a third plane of substantial symmetry of the third outer region of the first heat sink element, which third plane encompasses the axis of the trim element, the second plane of substantial symmetry defines an angle of at least 15 degrees relative to the third plane of substantial symmetry.

16. A lighting device as recited in claim 10, wherein:

the first heat sink element has at least three outer regions, including the first outer region of the first heat sink element, a second outer region of the first heat sink element and a third outer region of the first heat sink element, the first outer region of the first heat sink element has a first angle of inclination relative to the axis of the trim element, the second outer region of the first heat sink element has a second angle of inclination relative to the axis of the trim element, the third outer region of the first heat sink element has a third angle of inclination relative to the axis of the trim element, the first angle of inclination is equal to or differs from the second angle of inclination by not more than about 5 degrees, the first angle of inclination is equal to or differs from the third angle of inclination by not more than about 5 degrees, the second angle of inclination is equal to or differs from the third angle of inclination by not more than about 5 degrees, a first plane of substantial symmetry of the first outer region of the first heat sink element, which first plane encompasses the axis of the trim element, defines an angle of at least 15 degrees relative to a second plane of substantial symmetry of the second outer region of the first heat sink element, which second plane encompasses the axis of the trim element, the first plane of substantial symmetry defines an angle of at least 15 degrees relative to a third plane of substantial symmetry of the third outer region of the first heat sink element, which third plane encompasses the axis of the trim element, the second plane of substantial symmetry defines an angle of at least 15 degrees relative to the third plane of substantial symmetry.

17. A lighting device as recited in claim 10, wherein:

the lighting device comprises at least the first removable heat sink element and a second removable heat sink element, the second heat sink element comprises at least a first inner region and at least a first outer region, the first inner region of the second heat sink element closer to the axis of the trim element than the first outer region of the second heat sink element, and a contact portion of the first inner region of the first heat sink element is in contact with a contact portion of the first inner region of the second heat sink element.

18. A lighting device as recited in claim 17, wherein:

the first outer region of the first heat sink element has a first angle of inclination relative to the axis of the trim element, the first outer region of the second heat sink element has a second angle of inclination relative to the axis of the trim element, and the first angle of inclination differs from the second angle of inclination by at least 15 degrees.

19. A lighting device as recited in claim 2, wherein:

the lighting device further comprises a driver sub-assembly, the first removable heat sink element comprises at least a first surface and at least one spacer element extending from the first surface, and the first spacer element is between the trim element and the driver sub-assembly.

20. A lighting device as recited in claim 19, wherein:

a space is defined between the trim element and the driver sub-assembly, at least 60 percent of the volume in the space is vacant.

21. A lighting device as recited in claim 19, wherein:

a space is defined between the trim element and the driver sub-assembly, the lighting device further comprises at least a first removable heat sink structure, at least a portion of the first removable heat sink structure in the space.

22. A lighting device as recited in claim 1, wherein the lighting device further comprises a fixture element.

23. A lighting device as recited in claim 22, wherein the fixture element comprises a housing.

24. A lighting device as recited in claim 1, wherein the first light source comprises at least a first solid state light emitter.

25. A lighting device comprising:

at least a first light source; and at least a first removable heat dissipation means for dissipating heat and a second removable heat dissipation means for dissipating heat, a contact portion of the first removable heat dissipation means for dissipating heat in direct physical contact with a contact portion of the second removable heat dissipation means for dissipating heat, the first and second removable heat dissipation means for dissipating heat individually removable from each other and from the lighting device.

26. A lighting device as recited in claim 25, wherein the lighting device further comprises a trim element.

27. A lighting device comprising:

at least a first light source; and at least a first heat sink element, the first heat sink element comprising at least a first inner region and at least a first outer region and a second outer region, the first inner region of the first heat sink element closer to an axis of the lighting device than the first outer region of the first heat sink element, the first and second outer regions extending from the first inner region, an axis of substantial symmetry of the first outer region of the first heat sink element passes within a distance from the axis of the lighting device which is not greater than one-third of a dimension of the first outer region of the first heat sink element in a direction along the axis of substantial symmetry of the first outer region of the first heat sink element.

28. A lighting device as recited in claim 27, wherein:

the lighting device comprises at least the first heat sink element and a second heat sink element, the second heat sink element comprises at least a first inner region and at least a first outer region, the first inner region of the second heat sink element closer to the axis of the lighting device than the first outer region of the second heat sink element, and a contact portion of the first inner region of the first heat sink element in contact with a contact portion of the first inner region of the second heat sink element.

29. A lighting device as recited in claim 28, wherein:

the first outer region of the first heat sink element has a first angle of inclination relative to the axis of the lighting device, the first outer region of the second heat sink element has a second angle of inclination relative to the axis of the lighting device, and the first angle of inclination differs from the second angle of inclination by at least 15 degrees.

30. A lighting device as recited in claim 27, wherein:

the lighting device comprises at least the first heat sink element and a second heat sink element, the first heat sink element comprises a plurality of outer regions, each of the outer regions of the first heat sink element farther from the axis of the lighting device than the first inner region of the first heat sink element, the second heat sink element comprises at least a first inner region and a plurality of outer regions, each of the outer regions of the second heat sink element farther from the axis of the lighting device than the first inner region of the second heat sink element, a contact portion of the first inner region of the first heat sink element is in contact with a contact portion of the first inner region of the second heat sink element.

31. A lighting device as recited in claim 30, wherein angles of inclination of each of at least three outer regions of the second heat sink element differ by at least about 15 degrees from each angle of inclination of at least three outer regions of the first heat sink element.

32. A lighting device as recited in claim 27, wherein:

the lighting device comprises at least three heat sink elements including the first heat sink element, a second heat sink element and a third heat sink element, the first outer region of the first heat sink element has a first angle of inclination relative to the axis of the lighting device, a first outer region of the second heat sink element has a second angle of inclination relative to the axis of the lighting device, a first outer region of the third heat sink element has a third angle of inclination relative to the axis of the lighting device, the first angle of inclination differs from the second angle of inclination by at least about 15 degrees, the first angle of inclination differs from the third angle of inclination by at least about 15 degrees, and the second angle of inclination differs from the third angle of inclination by at least about 15 degrees.

33. A lighting device as recited in claim 32, wherein:

the first heat sink element has at least three outer regions, including the first outer region of the first heat sink element, a second outer region of the first heat sink element and a third outer region of the first heat sink element, the first outer region of the first heat sink element has a first angle of inclination relative to the axis of the lighting device, the second outer region of the first heat sink element has a second angle of inclination relative to the axis of the lighting device, the third outer region of the first heat sink element has a third angle of inclination relative to the axis of the lighting device, the first angle of inclination is equal to or differs from the second angle of inclination by not more than about 5 degrees, the first angle of inclination is equal to or differs from the third angle of inclination by not more than about 5 degrees, the second angle of inclination is equal to or differs from the third angle of inclination by not more than about 5 degrees, a first plane of substantial symmetry of the first outer region of the first heat sink element, which first plane encompasses the axis of the lighting device, defines an angle of at least 15 degrees relative to a second plane of substantial symmetry of the second outer region of the first heat sink element, which second plane encompasses the axis of the lighting device, the first plane of substantial symmetry defines an angle of at least 15 degrees relative to a third plane of substantial symmetry of the third outer region of the first heat sink element, which third plane encompasses the axis of the lighting device, the second plane of substantial symmetry defines an angle of at least 15 degrees relative to the third plane of substantial symmetry.

34. A lighting device as recited in claim 27, wherein:

the first heat sink element has at least three outer regions, including the first outer region of the first heat sink element, a second outer region of the first heat sink element and a third outer region of the first heat sink element, the first outer region of the first heat sink element has a first angle of inclination relative to the axis of the lighting device, the second outer region of the first heat sink element has a second angle of inclination relative to the axis of the lighting device, the third outer region of the first heat sink element has a third angle of inclination relative to the axis of the lighting device, the first angle of inclination is equal to or differs from the second angle of inclination by not more than about 5 degrees, the first angle of inclination is equal to or differs from the third angle of inclination by not more than about 5 degrees, the second angle of inclination is equal to or differs from the third angle of inclination by not more than about 5 degrees, a first plane of substantial symmetry of the first outer region of the first heat sink element, which first plane encompasses the axis of the lighting device, defines an angle of at least 15 degrees relative to a second plane of substantial symmetry of the second outer region of the first heat sink element, which second plane encompasses the axis of the lighting device, the first plane of substantial symmetry defines an angle of at least 15 degrees relative to a third plane of substantial symmetry of the third outer region of the first heat sink element, which third plane encompasses the axis of the lighting device, the second plane of substantial symmetry defines an angle of at least 15 degrees relative to the third plane of substantial symmetry.

35. A lighting device as recited in claim 27, wherein the at least first outer region and second outer region extend radially from the first inner region.

36. A lighting device as recited in claim 27, wherein there is space between the first outer region and the second outer region.

37. A lighting device as recited in claim 27, wherein the first light source comprises at least a first solid state light emitter.

38. A lighting device comprising:

at least a first light source;

a trim element;

a driver sub-assembly, and at least a first spacer element, the first spacer element between the trim element and the driver sub-assembly, the at least a first spacer element separating the trim element from the driver sub-assembly such that a region on the trim element is exposed to open air, the driver sub-assembly comprising a first component and a second component, the first component electrically connected to a power source, the second component electrically connected to the first light source, wherein the driver sub-assembly receives AC current at or through the first component and supplies DC current at or through the second component.

39. A lighting device as recited in claim 38, wherein:

a space is defined between the trim element and the driver sub-assembly, at least 60 percent of the volume in the space is vacant.

40. A lighting device as recited in claim 38, wherein:

a space is defined between the trim element and the driver sub-assembly, the lighting device further comprises at least a first heat sink structure, at least a portion of the first heat sink structure in the space.

41. A lighting device comprising:

at least a first light source;

a trim element; and at least a first heat sink element, wherein:

the first heat sink element comprises an inner surface and an outer surface, every point on the first heat sink element is on the inner surface of the first heat sink element, on the outer surface of the first heat sink element or between the inner surface of the first heat sink element and the outer surface of the first heat sink element, the inner surface of the first heat sink element has a shape that is substantially the same as the shape of the outer surface of the first heat sink element, and (1) the outer surface of the first heat sink element follows a contour of at least a first portion of an inner surface of the trim element, the first portion of the inner surface of the trim element has a shape that is substantially the same as the shape of the outer surface of the first heat sink element, and the inner surface of the first heat sink element is in direct physical contact with the first light source, or (2) the inner surface of the first heat sink element follows a contour of a first portion of an outer surface of the trim element, the first portion of the outer surface of the trim element has a shape that is substantially the same as the shape of the inner surface of the first heat sink element, and the trim element comprises a rim configured to be in contact with a ceiling in which the lighting device is mounted.

42. A lighting device as recited in claim 41, wherein the inner surface of the first heat sink element is in direct physical contact with the first light source.

43. A lighting device as recited in claim 41, wherein the first portion of the inner surface of the trim element is in direct physical contact with the first light source.

44. A lighting device as recited in claim 41, wherein the inner surface of the first heat sink element, and the outer surface of the first heat sink element are substantially frustoconical.

45. A lighting device as recited in claim 41, wherein the outer surface of the first heat sink element is in direct contact with the first portion of the inner surface of the trim element.

46. A lighting device comprising:

at least a first light source; and at least first, second and third heat sink elements, each of the heat sink elements comprising at least a first inner region and at least a first outer region, the first inner regions of each heat sink element closer to an axis of the lighting device than the first outer regions of each heat sink element, the inner regions of the heat sink elements stacked so that at least one surface of each inner region of each heat sink element is in direct physical contact with a surface of an inner region of another heat sink element, the first heat sink element in direct physical contact with the second heat sink element, the second heat sink element in direct physical contact with the third heat sink element.

47. A lighting device as recited in claim 46, wherein the first light source comprises at least a first solid state light emitter.

48. A lighting device comprising:

at least a first light source;

a trim element; and at least a first heat sink element, the first heat sink element removable from the lighting device, the first heat sink element having a first region and at least first and second extension regions extending away from the first region in different directions, a width of at least the first extension region larger at a first distance from an axis of the trim element than at a second distance from the axis of the trim element, the first distance larger than the second distance.

49. A lighting device as recited in claim 48, wherein a cross-sectional area of the first heat sink element increases as distance from the axis of the trim element increases for at least 50% of a length of the first heat sink element in a direction extending away from the axis of the trim element.

50. A lighting device as recited in claim 48, wherein the lighting device further comprises a second heat sink element, a cross-sectional area of the second heat sink element at the first distance from the axis of the trim element larger than a cross-sectional area of the second heat sink at the second distance from the axis of the trim element.

51. A lighting device comprising:

at least a first light source;

a trim element; and at least two heat sink elements, comprising a first heat sink element and a second heat sink element, a shape of the first heat sink element and a shape of the second heat sink element substantially identical, the first heat sink element comprising a first group of fins, the second heat sink element comprising a second group of fins, the first and second heat sink elements stacked with the second heat sink element rotated about an axis of the trim element at least five degrees relative to the first heat sink element so that the fins in the first group of fins are not in contact with the fins in the second group.

52. A lighting device as recited in claim 51, wherein the first light source comprises at least a first solid state light emitter.

53. A lighting device comprising:

at least a first light source;

a trim element; and at least four heat sink elements, each of the heat sink elements comprising at least a first inner region and at least a first outer region, the first inner regions of each heat sink element closer to an axis of the trim element than the first outer regions of each heat sink element, the inner regions of the heat sink elements stacked so that at least one surface of each inner region of each heat sink element is in direct physical contact with a surface of an inner region of another heat sink element.

54. A method of dissipating heat from a solid state lighting device, comprising:

nesting a predefined number of removable heat sink elements, wherein the predefined number of removable heat sink elements is at least three and is based on a power consumption of the solid state lighting device, and wherein each of the removable heat sink elements is in direct physical contact with at least one other of the removable heat sink elements.

55. A lighting device comprising:

at least one solid state lighting device; and a predefined number of individually removable heat sink elements thermally coupled to the at least one solid state lighting device, wherein the predefined number of removable heat sink elements is at least three and is selected to maintain a junction temperature of the at least one solid state lighting device at or below a recommended junction temperature for a selected lifetime of the at least one solid state lighting device, each of the removable heat sink elements in direct physical contact with at least one other of the removable heat sink elements.

56. A lighting device comprising:

at least a first light source; and at least a first heat sink element and a second heat sink element, the first heat sink element comprising at least a first inner region and at least a first outer region and a second outer region, locations on the first inner region of the first heat sink element closer to an axis of the lighting device than locations on the first outer region of the first heat sink element, the first and second outer regions extending from the first inner region, the second heat sink element comprises at least a first inner region and at least a first outer region, locations on the first inner region of the second heat sink element closer to the axis of the lighting device than locations on the first outer region of the second heat sink element, a contact portion of the first inner region of the first heat sink element in contact with a contact portion of the first inner region of the second heat sink element, the first outer region of the first heat sink element having a first angle of inclination relative to the axis of the lighting device, the first outer region of the second heat sink element having a second angle of inclination relative to the axis of the lighting device, and the first angle of inclination differing from the second angle of inclination by at least 15 degrees.

57. A lighting device comprising:

at least a first light source; and at least a first heat sink element and a second heat sink element, the first heat sink element comprising at least a first inner region and a plurality of outer regions including at least a first outer region and a second outer region, the first inner region of the first heat sink element closer to an axis of the lighting device than the first outer region of the first heat sink element, the first and second outer regions extending from the first inner region, each of the outer regions of the first heat sink element farther from the axis of the lighting device than the first inner region of the first heat sink element, the second heat sink element comprising at least a first inner region and a plurality of outer regions, each of the outer regions of the second heat sink element farther from the axis of the lighting device than the first inner region of the second heat sink element, a contact portion of the first inner region of the first heat sink element is in direct physical contact with a contact portion of the first inner region of the second heat sink element.

58. A lighting device as recited in claim 41, wherein the trim element is in contact with (1) substantially an entirety of the inner surface of the first heat sink element or (2) substantially an entirety of the outer surface of the first heat sink element.

59. A lighting device comprising:

at least a first light source, a trim element; and at least a first removable heat sink element, the first heat sink element comprising at least a first inner region and at least a first outer region, the first inner region of the first heat sink element closer to an axis of the trim element than the first outer region of the first heat sink element, an axis of substantial symmetry of the first outer region of the first heat sink element passing within a distance from the axis of the trim element which is not greater than one-third of a dimension of the first outer region of the first heat sink element in a direction along the axis of substantial symmetry of the first outer region of the first sink element.

60. A lighting device comprising:

at least a first light source, a driver sub-assembly, a trim element; and at least a first removable heat sink element and a second removable heat sink element, at least the first removable heat sink element and the second removable heat sink element between a portion of the driver sub-assembly and a portion of the trim element, a shape of the first removable heat sink element and a shape of the second removable heat sink element substantially identical, with the second removable heat sink element rotated about the axis of the trim element at least five degrees relative to the first removable heat sink element.

61. A lighting device comprising:

at least a first light source; and at least a first heat sink element, a second heat sink element and a third heat sink element, the first heat sink element comprising at least a first inner region and at least a first outer region and a second outer region, locations on the first inner region of the first heat sink element closer to an axis of the lighting device than locations on the first outer region of the first heat sink element, the first and second outer regions extending from the first inner region the first outer region of the first heat sink element having a first angle of inclination relative to the axis of the lighting device, a first outer region of the second heat sink element having a second angle of inclination relative to the axis of the lighting device, a first outer region of the third heat sink element having a third angle of inclination relative to the axis of the lighting device, the first angle of inclination differing from the second angle of inclination by at least about 15 degrees, the first angle of inclination differing from the third angle of inclination by at least about 15 degrees, and the second angle of inclination differing from the third angle of inclination by at least about 15 degrees.

* * * * *